US006714164B2

(12) United States Patent
Shimizu

(10) Patent No.: US 6,714,164 B2
(45) Date of Patent: Mar. 30, 2004

(54) MULTIFREQUENCY ANTENNA

(75) Inventor: Hiroshi Shimizu, Warabi (JP)

(73) Assignee: Nippon Antena Kabushiki Kaisha (JP)

( * ) Notice: Subject to any disclaimer, the term of this patent is extended or adjusted under 35 U.S.C. 154(b) by 0 days.

(21) Appl. No.: 10/240,569

(22) PCT Filed: Jan. 22, 2002

(86) PCT No.: PCT/JP02/00407

§ 371 (c)(1),
(2), (4) Date: Oct. 3, 2002

(87) PCT Pub. No.: WO02/069444

PCT Pub. Date: Sep. 6, 2002

(65) Prior Publication Data

US 2003/0137463 A1 Jul. 24, 2003

(30) Foreign Application Priority Data

Feb. 26, 2001 (JP) ..... 2001-050642

(51) Int. Cl.[7] ..... H01Q 1/32
(52) U.S. Cl. ..... 343/715; 343/711; 343/725
(58) Field of Search ..... 343/711, 715, 343/722, 850, 860, 904, 906, 725

(56) References Cited

U.S. PATENT DOCUMENTS 5,451,967 A * 9/1995 Ueda et al. ..... 343/715
5,463,405 A * 10/1995 Liu et al. ..... 343/715
5,600,333 A * 2/1997 Justice et al. ..... 343/713
5,966,097 A 10/1999 Fukasawa et al. ... 343/700 MS

FOREIGN PATENT DOCUMENTS

| | | | |
|---|---|---|---|
| EP | 637093 A1 | 2/1995 | ..... H01Q/5/02 |
| JP | 02-098202 | 4/1990 | ..... H01Q/1/32 |
| JP | 07-094929 | 4/1995 | ..... H01Q/5/01 |
| JP | 09-326632 | 12/1997 | ..... H01Q/21/30 |

OTHER PUBLICATIONS

International Search Report, PCT/JP02/00407, Apr. 16, 2002, p. 1.

* cited by examiner

*Primary Examiner*—Hoang V. Nguyen
(74) *Attorney, Agent, or Firm*—Connolly, Bove, Lodge & Hutz, LLP

(57) ABSTRACT

An antenna is compactified whilst being able to operate across at least two different broad frequency bands. An antenna circuit board 7 on which an antenna pattern 7*a* and a passive element pattern 7*b* are formed is accommodated inside an antenna case. An antenna element is connected electrically to the upper end of the antenna pattern 7*a*. An antenna operating in the GSM and DCS frequency bands is constituted by a telephone element provided on the lower portion of the antenna element and the antenna pattern 7*a* and passive element pattern 7*b* formed on the antenna circuit board 7. Thereby, a compactified antenna is enabled to operate across two different broad frequency bands.

5 Claims, 29 Drawing Sheets f = 1 7 1 0 MHz
GAIN + 2. 5 5 dB f = 1 7 9 5 MHz
GAIN +1. 8 2 dB f = 1 8 8 0 MHz
GAIN +1. 9 8 dB f = 1 7 1 0 MHz
GAIN −4. 3 3 dB f = 1 7 9 5 MHz
GAIN −1. 9 dB f = 1 8 8 0 MHz
GAIN −1. 5 9 dB f = 1 7 9 5 MHz
GAIN −0. 8 3 dB f = 1 8 8 0 MHz
GAIN −0. 5 1 dB f = 870MHz
GAIN −0.15dB f = 915MHz
GAIN +0.8dB f = 960MHz
GAIN −0.47dB f = 870MHz
GAIN −0.01dB f = 915MHz
GAIN +1.24dB f = 960MHz
GAIN +1.21dB f = 915MHz
GAIN −1.13dB f = 960MHz
GAIN −1.43dB

MULTIFREQUENCY ANTENNA

TECHNICAL FIELD

The present invention relates to a multi-frequency antenna capable of operating in two different mobile radio bands and FM/AM radio bands.

BACKGROUND ART

There are known various types of antenna that are installed on vehicles, but conventionally, roof vehicles which are installed on the vehicle roof have been preferred since they enable reception sensitivity to be improved by means of the antenna being installed of the roof which is the highest position on the vehicle. Moreover, since an FM/AM radio is generally fitted in a vehicle, it is convenient to use an antenna capable of receiving both FM and AM radio bands, and hence roof antennas which are capable of receiving two radio bands conjointly have been widespread.

If a mobile telephone is mounted in a vehicle, then an antenna for the mobile telephone is fitted to the vehicle. In this case, if the number of usable frequencies for mobile telephones has become insufficient due to an increase in the number of subscribers, then there may be cases where two frequency bands are allocated for mobile telephone use, namely, a frequency band which can be used in all regions, and a frequency band which can be used in urban areas. For example, in Europe, mobile telephones using the 900 MHz band Global System for Mobile communication (GSM) can be used in all regions of Europe, but in urban areas, in order to compensate for the insufficiency of usable frequencies, mobile telephones using the 1.8 GHz Digital Cellular System (DCS) can also be used. If corresponding antennas are fitted respectively and independently in a vehicle, then design problems arise and maintenance and installation tasks, and the like, become more complex, and hence multi-frequency antennas which can receive two frequency bands for mobile telephones, and FM/AM radio bands, in a single antenna, have been proposed.

A multi-frequency antenna disclosed in Japanese Patent Publication No. 06-132714 is known as one example of this type of multi-frequency antenna. This multi-frequency antenna is constituted by a retractable rod antenna forming a combined three-wave antenna for receiving a mobile telephone band, FM radio band, and AM radio band, a planar radiating element forming a GPS antenna for receiving GPS signals, and a loop radiating element forming a keyless entry antenna for receiving keyless entry signals.

These antennas are installed on the upper face of a main body, and a metal plate is provided in the upper portion of the main body, the planar radiating body and the loop radiating body being formed on this plate via an inductive layer. Since the plate forms a ground plane, the planar radiating element and the loop radiating element operate as microstrip antennas. Furthermore, a protective cover is formed over the planar radiating element and loop radiating element.

Since a multi-frequency antenna of this kind comprises a retractable rod antenna, it is necessary to provide a space for accommodating the rod antenna when it is installed. Therefore, whilst it is possible to install the multi-frequency antenna on the boot lid or wing of the vehicle where such space can be formed, it cannot be installed on the roof, which is the optimum position for situating an antenna, since this does not have the required accommodating space.

Therefore, a multi-frequency antenna designed to resolve this problem is disclosed in Japanese Patent Publication No. 10-93327.

This multi-frequency antenna is constituted by an antenna element designed to resonate at multiple frequencies by being provided with a trap coil, and a cover section having a built-in matching circuit board, or the like, on which this antenna element is installed. By fixing this cover section to the roof, the multi-frequency antenna can be installed on the roof.

With increase in the number of mobile telephone users, a plurality of frequency bands have been allocated for mobile telephone use. For example, in the PDC (Personal Digital Cellular telecommunication system) used in Japan, the 800 MHz band (810 MHz–956 MHz) and 1.4 GHz band (1429 MHz–1501 MHz) are allocated. In Europe, the 800 MHz (870 MHz–960 MHz) GSM (Global System for Mobile communications) and the 1.7 GHz (1710 MHz–1880 MHz) DCS (Digital Cellular System) are employed. To operate an antenna in a plurality of operating frequencies of this kind, antennas which operate in the respective frequency bands are provided, but generally, two antennas are connected by means of a choke coil so that they do not mutually affect the operation of the other.

However, in a choke coil, such as a trap coil, or the like, it is difficult to separate signals across a broad frequency range. In other words, even if a choke coil is provided between antennas operating in respective frequency bands, if the frequency bandwidths are large, as in mobile telephone bands, then it is not possible to make the respective antennas work independently across these frequency bands, and hence there is a problem in that the antennas affect each other and cannot be made to operate satisfactorily.

Moreover, a problem also arises in that the antenna increases in size due to the inclusion of a choke coil.

DISCLOSURE OF THE INVENTION

Therefore, it is an object of the present invention to provide a compactified multi-frequency antenna which operates across at least two broad frequency bands.

In order to achieve the aforementioned object, the multi-frequency antenna according to the present invention is a multi-frequency antenna comprising: an antenna circuit board, on which are formed an antenna pattern and a passive element pattern, in the proximity of the antenna pattern; an antenna case section for accommodating the antenna circuit board; and an antenna element, wherein a choke coil is disposed between an upper element and a lower element, the lower end of the lower element being connected to the upper end of the antenna pattern formed on the antenna circuit board when the antenna element is installed on the antenna case section; wherein antenna means comprising the lower element, the antenna pattern and the passive element pattern is able to operate in a first frequency band, and a second frequency band, which is approximately double the frequency of the first frequency band.

Moreover, in the multi-frequency antenna according to the present invention described above, the first frequency band and the second frequency band may be mobile radio bands.

Furthermore, in the multi-frequency antenna according to the present invention described above, the whole of the antenna including the upper element and the choke coil may be able to operate in a third frequency band, which is lower than the first frequency band.

Moreover, in the multi-frequency antenna according to the present invention described above, frequency dividing means for dividing the first frequency band and the second frequency band from the third frequency band may be incorporated into a circuit board accommodated inside the antenna case section.

Furthermore, in the multi-frequency antenna according to the present invention described above, the frequency dividing means may include a matching circuit for the first frequency band and the second frequency band.

According to the present invention, antenna means comprising a lower element, and an antenna pattern and passive element pattern formed on an antenna circuit board, is able to operate in a first frequency band and a second frequency band, which is approximately double the frequency of the first frequency band, without using a choke coil, and hence the multi-frequency antenna can be compactified.

Moreover, FM/AM broadcasts can be received by the whole antenna including an upper antenna connected via a choke coil to the lower element. The multi-frequency signal received by the multi-frequency antenna is divided by frequency dividing means into a mobile radio signal and an FM/AM signal. In this case, a matching circuit can also be incorporated into the section for dividing the mobile radio bands, and since the frequency dividing means is accommodated inside the antenna case section, a more compact composition for the multi-frequency antenna can be achieved.

BRIEF DESCRIPTION OF THE DRAWINGS

FIG. 4 is a diagram showing horizontal-plane radiation pattern at 915 MHz for a multi-frequency antenna according to an embodiment of the present invention;

BEST MODE FOR CARRYING OUT THE INVENTION

Figure 1:
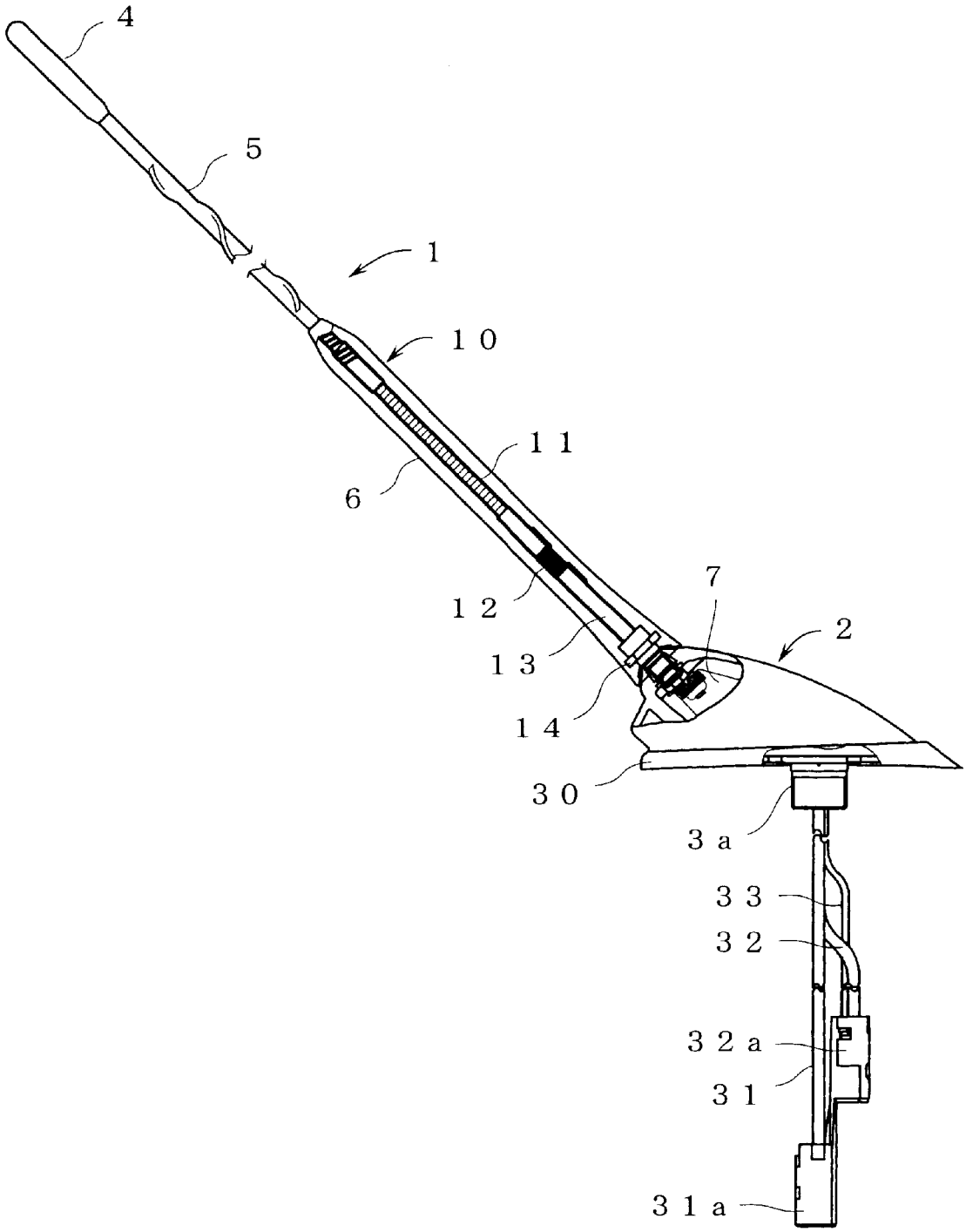
FIG. 1 is a diagram showing the overall composition of a multi-frequency antenna according to an embodiment of the present invention.
Figure 2:
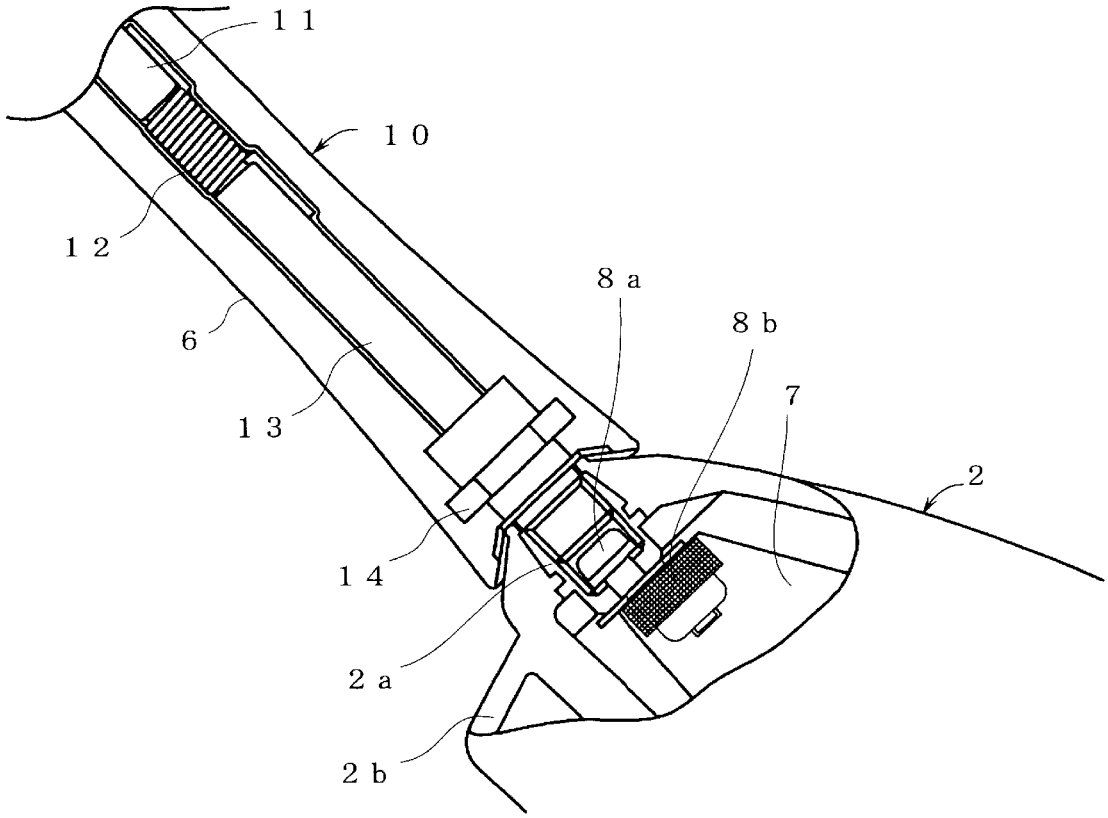
FIG. 2 is a diagram showing an enlarged view of one portion of a multi-frequency antenna according to an embodiment of the present invention.

FIG. 1 and FIG. 2 show the composition of an embodiment of a multi-frequency antenna according to the present invention. FIG. 1 shows the overall composition of a multi-frequency antenna according to the present invention and FIG. 2 shows an enlarged view of one portion thereof.

As shown in these diagrams, the multi-frequency antenna 1 according to the present invention is constituted by an antenna element 10 forming a whip antenna, and an antenna case section 2 on which the antenna element 10 is installed detachably. The antenna case section 2 is constituted by a metallic antenna base section 3 (see FIG. 3 and FIG. 4) and a cover section 2*b* made from resin, which engages with the antenna base section 3. The antenna element 10 comprises a bendable elastic element section 11, a helical element section 5 formed in a helical shape provided on the upper end of the bendable elastic element section 11, and an antenna top 4 provided on the upper end of the helical element section 5. Moreover, one end of a choke coil 12 is connected to the lower end of the elastic element section 11 and the other end of the choke coil 12 is connected to a telephone element 13 which corresponds to an upper element for D net (GSM) use. A fixing screw section 14 is provided at the lower end of the telephone element 13. An antenna stem section 6 is formed by moulding over the lower portion of the helical element section 5, and over the elastic element section 11, the choke coil 12, telephone element 13 and the upper portion of the fixing screw section 14. In this case, the telephone element 13 forms a lower element of the antenna element 10.

Here, "D-net" indicates a mobile radio band based on the aforementioned GSM system, and "E-net", which is mentioned hereinafter, indicates a second mobile radio band based on the aforementioned DCS system.

Incidentally, wind noise preventing means wound in a coil shape is also provided on the surface of the helical element section 5. Moreover, the elastic element section 11 serves to absorb load by bending when lateral load is applied to the antenna element 10, thereby preventing snapping thereof. This elastic element section 11 can be constituted by an elastic wire cable or coil spring.

Figure 3:
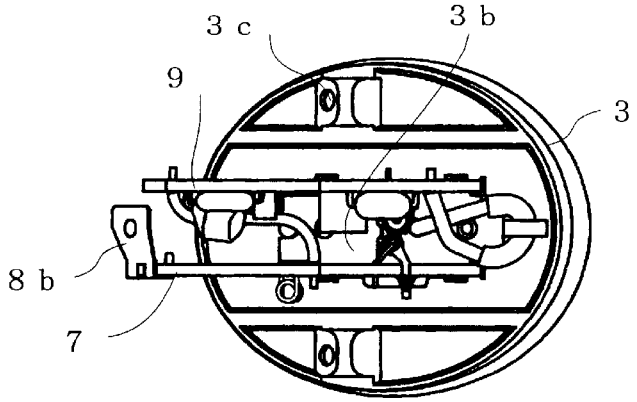
FIG. 3 is a plan view of the composition of a multi-frequency antenna according to an embodiment of the present invention, wherein the antenna element and cover section have been removed.
Figure 4:
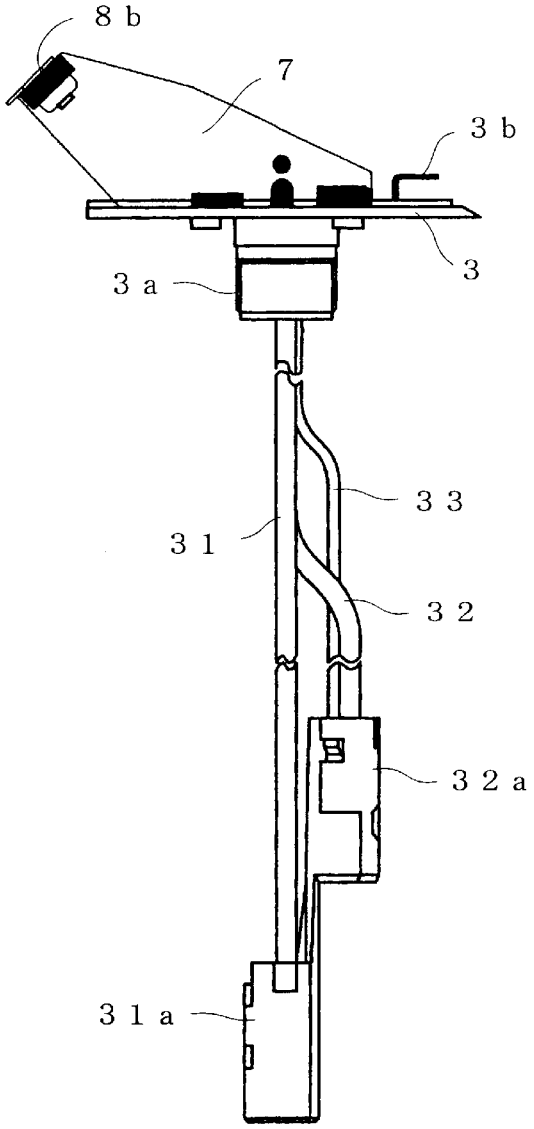
FIG. 4 is a plan view of the composition of a multi-frequency antenna according to an embodiment of the present invention, wherein the antenna element and cover section have been removed.

Here, FIG. 3 shows a plan view of the composition of a multi-frequency antenna 1, wherein the antenna element 10 and cover section 2*b* have been removed, and FIG. 4 shows a plan view thereof. The multi-frequency antenna 1 is now described with reference to these diagrams.

The cover section 2*b* made by resin moulding is fitted to the metallic antenna base section 3 illustrated in FIG. 3 and FIG. 4, and a circular tubular installation section 3*a* for installation onto the roof, or the like, of a vehicle is formed projecting from the antenna base section 3. A screw thread is cut into the outer circumference of the installation section 3*a*, and by engaging a nut with this installation section 3*a*, the antenna base section 3 and the nut can be fixed in position on either side of the vehicle body. The antenna base section 3 and the cover section 2*b* are united by passing a pair of screws through a pair of screw clearance holes 3*c* formed in the antenna base section 3, from the surface thereof, and screwing same into the cover section 2*b*. A through hole is formed in the axial direction of the installation section 3*a*, and a D-net and E-net telephone output cable 31, AM/FM output cable 32 and power supply cable 33 are led out from inside the antenna case section 2 via this through hole. In this case, a cutaway groove (not illustrated) is formed in the through hole in the installation section 3*a*, and by using this cutaway groove, the telephone output cable 31 and AM/FM output cable 32 can be conducted in approximately parallel fashion to the rear face of the antenna base section 3. A first terminal 31*a* is provided on the front end of the telephone output table 31, and a second terminal 32*a* is provided on the front end of the AM/FM output cable 32, these terminals 31*a*, 32*a* being connected to corresponding devices installed respectively inside the vehicle.

A hot shoe 2*a* to which the antenna element 10 is attached removably is formed as an insert on the upper end of the cover section 2*b* forming the antenna case section 2. By screwing the fixing screw section 14 of the antenna element 10 onto this hot shoe 2*a*, the antenna element 10 can be fixed mechanically and electrically to the antenna case section 2. Two printed circuit boards, namely, an antenna circuit board 7 and an amplifier circuit board 9 are accommodated in upright fashion inside the antenna case section 2. The antenna circuit board 7 and the amplifier circuit board 9 are fixed in upright fashion by soldering to an earth fixture 3*b* which is attached to the upper face of the antenna base section 3. A connecting piece 8*b* bent in an L-shape is affixed by soldering, or the like, to the upper end of the antenna circuit board 7, and a connecting screw 8*a* is screwed into the connecting piece 8*b* from the inside of the hot shoe 2*a*. Thereby, the antenna element 10 affixed to the hot shoe 2*a* becomes electrically connected to the antenna circuit board 7, via the connecting screw 8*a* and the connecting piece 8*b*.

The characteristic compositional feature of the multi-frequency antenna 1 according to the present invention is the provision of an antenna circuit board 7 that is accommodated inside the antenna case section 2. An antenna pattern 7*a* which operates as an E-net antenna is formed on the antenna circuit board 7. This antenna pattern 7*a* also operates as a D-net element is conjunction with the telephone element 13. Here, the composition of the antenna circuit board 7 is described with reference to FIG. 7 and FIG. 8.

Figure 7:
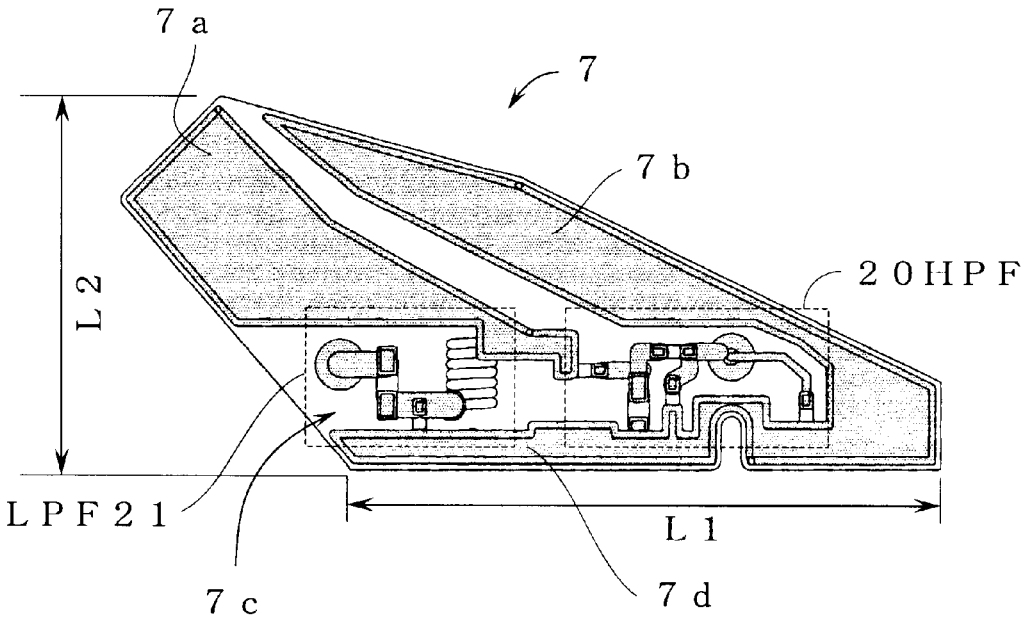
FIG. 7 is a diagram showing the composition of the front face of an antenna circuit board in a multi-frequency antenna according to an embodiment of the present invention.
Figure 8:
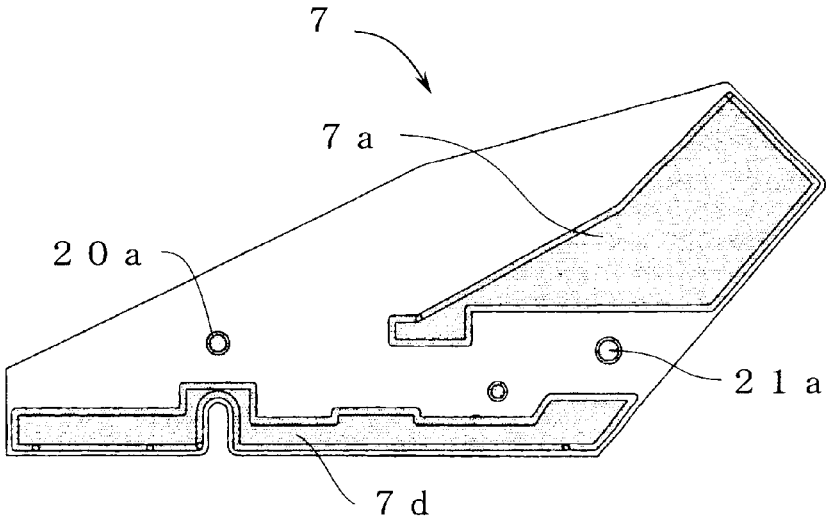
FIG. 8 is a diagram showing the composition of the rear face of an antenna circuit board in a multi-frequency antenna according to an embodiment of the present invention.

FIG. 7 shows the composition of the front face of an antenna circuit board 7, and FIG. 8 shows the composition of the rear face of an antenna circuit board 7. As shown in these diagrams, the antenna circuit board 7 has a hexagonal shape which is modified to match the shape of the internal space of the antenna case section 2. A wide antenna pattern 7*a* is formed from the upper part to the central part of the front face of the antenna circuit board 7, and a wide antenna pattern 7*a* of approximately the same shape is formed on the rear face of the antenna circuit board 7. Although not illustrated in the drawings, the antenna patterns 7*a* on the front face and rear face are connected mutually by means of a plurality of through holes. Moreover, a parasitic element pattern 7*b* is formed on the antenna circuit board 7 in the proximity of the antenna patterns 7*a*. The lower edge of this parasitic element pattern 7*b* is connected to an earth pattern 7*d*. By forming a parasitic element pattern 7*b*, the antenna pattern 7*a* is also able to function in the DCS (E-net) frequency band. The earth pattern 7*d* is formed on lower part of the front face and rear face of the antenna circuit board 7. Between the antenna pattern 7*a*, the parasitic element pattern 7*b* and the earth pattern 7*d*, there is formed a circuit pattern 7*c* incorporating a low-pass filter (LPF) 21 and a high-pass filter (HPF) 20 comprising a matching circuit, which form a frequency dividing circuit for dividing signals into respective frequency bands. On the antenna circuit board 7, a through hole 21*a* is provided in the output section of the LPF 21 and a through hole 20*a* is provided in the output section of the HPF 20.

To give an example of the dimensions of the antenna circuit board 7, the width L1 of the antenna circuit board 7 is approximately 49.5 mm, the height L2 is approximately 21.9 mm. Moreover, the length of the parasitic element pattern 7*b* is approximately 40 mm, and the interval between the antenna pattern 7*a* and the parasitic element pattern 7*b* is approximately 2–3 mm. These dimensions relate to a case where the antenna pattern 7*a* and parasitic element pattern 7*b* are used for E-net and D-net communications, and the aforementioned dimensions will differ if the antenna is used for different frequency bands.

The parasitic element pattern 7*b* may also be formed on the rear face of the antenna circuit board 7, instead of the front face thereof, and moreover, the parasitic element pattern 7*b* does not necessarily have to be connected to the earth pattern 7*d*.

Figure 5:
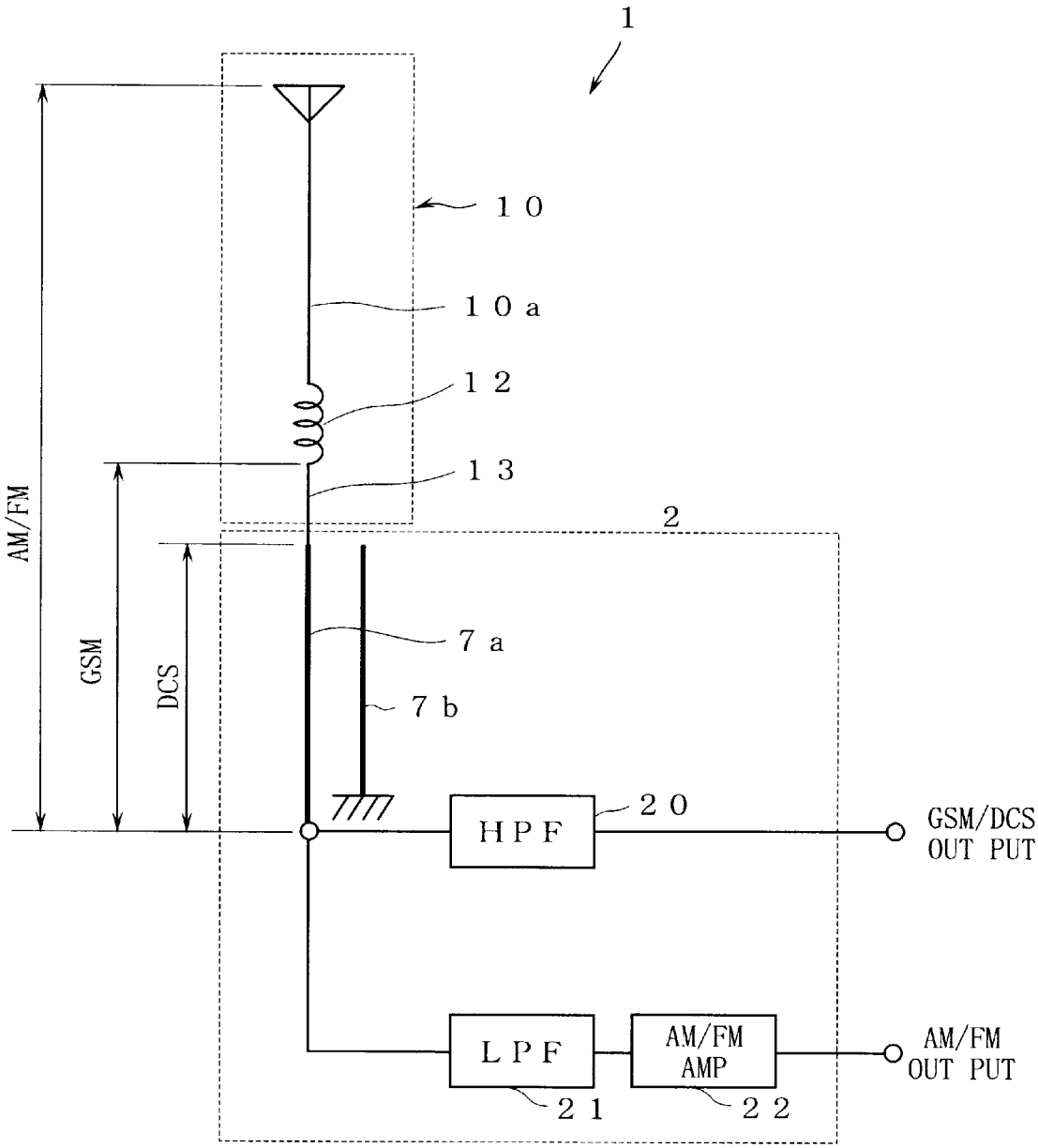
FIG. 5 is a circuit showing an equivalent circuit of a multi-frequency antenna according to an embodiment of the present invention.

FIG. 5 shows an equivalent circuit of a multi-frequency antenna 1 provided with an antenna circuit board 7 having the composition illustrated in FIG. 7 and FIG. 8. As shown in FIG. 1 to FIG. 3, a metallic connecting piece 8*b* is provided on the upper end of the antenna circuit board 7, and this connecting piece 8*b* is connected to the upper end of the antenna pattern 7*a*. By screwing the fixing screw section 14 of the antenna element 10 into the hot shoe 2*a* of the antenna case section 2, the antenna element becomes electrically connected to the connecting piece 8*b* which is in turn connected via the connecting screw 8*a* to the hot shoe 2*a*. Thereby, the upper element 10*a* consisting of helical element section 5 and elastic element section 11, the choke coil 12, the telephone element 13 and the antenna pattern 7*a* are connected in series, as illustrated in FIG. 5. The parasitic element pattern 7*b* is provided in the proximity of the antenna pattern 7*a*.

The multi-frequency antenna 1 according to the present invention is capable of receiving signals by resonating with an FM broadcast by means of the entire antenna, as well as being able to receive AM broadcasts. Moreover, in the D-net and E-net mobile radio bands, the choke coil 12 becomes high impedance and is isolated, whereby the telephone element 13, antenna pattern 7*a* and parasitic element pattern 7*b* resonate with the D-net and become able to send and receive communications in the GSM frequency band, whilst also resonating with the E-net and being able to send and receive communications in the DCS frequency band. However, it will still be understood fully why the antenna comprising a telephone element 13, antenna pattern 7*a* and parasitic element pattern 7*b* is able to operate in both E-net and D-net bands. Moreover, the antenna circuit board 7 incorporates a frequency dividing circuit consisting of an HPF 20 and LPF 21 for dividing signals in the AM/FM frequency band, and signals in the D-net and E-net frequency bands, whilst the amplifier circuit board 9 incorporates an amplifying circuit for amplifying the divided AM/FM frequency bands.

In other words, the output end of the multi-frequency antenna 1 is connected to an HPF 20 and LPF 21, the D-net and E-net frequency components are divided off by the HPF 20 and the divided signal is output from the GSM/DCS output terminals. Moreover, the AM/FM frequency components are divided off by the LPF 21 and the divided signal is amplified by the AM/FM amplifier 22 in the amplifier circuit board 9 and output from the AM/FM output terminals. Furthermore, in order to improve the characteristics of the multi-frequency antenna 1, a matching circuit is incorporated into the HPF 20.

Figure 6:
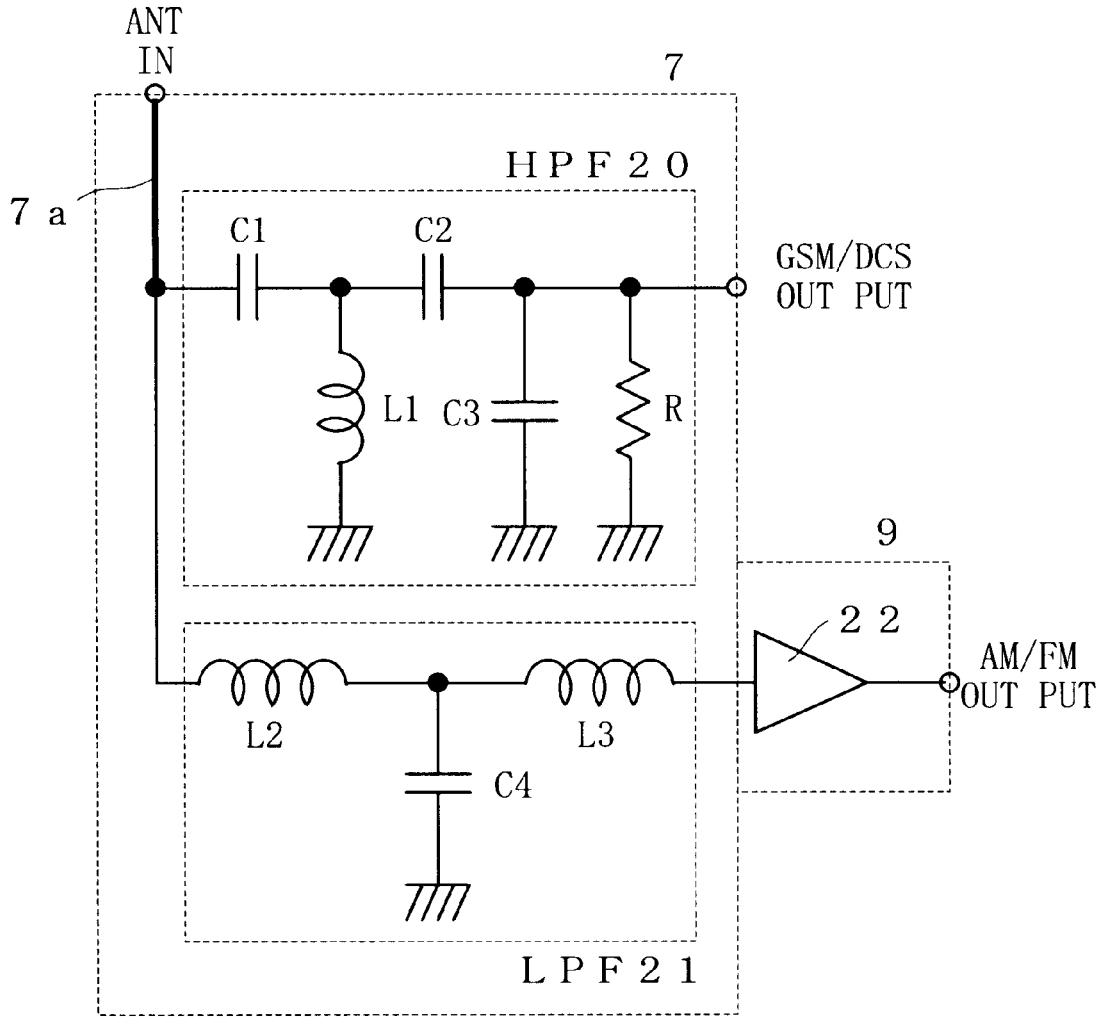
FIG. 6 is a circuit diagram of a frequency dividing circuit incorporated into an antenna circuit board in a multi-frequency antenna according to an embodiment of the present invention.

Here, FIG. 6 shows one example of the circuitry of the HPF 20 and LPF 21 incorporated into the antenna circuit board 7.

The terminal ANT IN of the antenna circuit board 7 corresponds to the connecting piece 8*b* connected to the top end of the antenna pattern 7*a*. HPF 20 is connected to the lower end of the antenna pattern 7*a* and is a T-type high-pass filter comprising two serially connected capacitors C1, C2, and an inductor L1 placed between these and an earth. Moreover, a capacitor C3 and a resistance R for regulating the output impedance are connected between the output side of the capacitor C2 and the earth. In the HPF 20, the D-net and E-net frequency components are divided off and the divided signal is output to the GSM/DCS output terminal. The capacitor C3 and T-type high-pass filter also function as a matching circuit for regulating the impedance between the multi-frequency antenna 1 and the radio device.

On the other hand, the LPF 21 is also connected to the lower end of the antenna pattern 7*a*, and it comprises a T-type low-pass filter consisting of serially connected inductors L2, L3, and a capacitor C4 connected between these and an earth. The AM/FM frequency components divided by the LPF 21 are supplied from the antenna circuit board 7 to the amplifier circuit board 9, where they are amplified by the AM/FM amplifier 22 in the amplifier circuit board 9 and then output from the AM/FM output terminal.

In the antenna circuit board 7, by placing the parasitic element pattern 7*b* in the proximity of the antenna pattern 7*a*, the antenna formed by the telephone element 13 and the antenna pattern 7*a* fabricated on the antenna circuit board 7 is able to operate in the DCS frequency band also. In order to describe the action of this parasitic element pattern 7*b*, the antenna characteristics in a case where the shape of the parasitic element pattern 7*b* is changed from the shape illustrated in FIG. 7 is described below.

Figure 45:
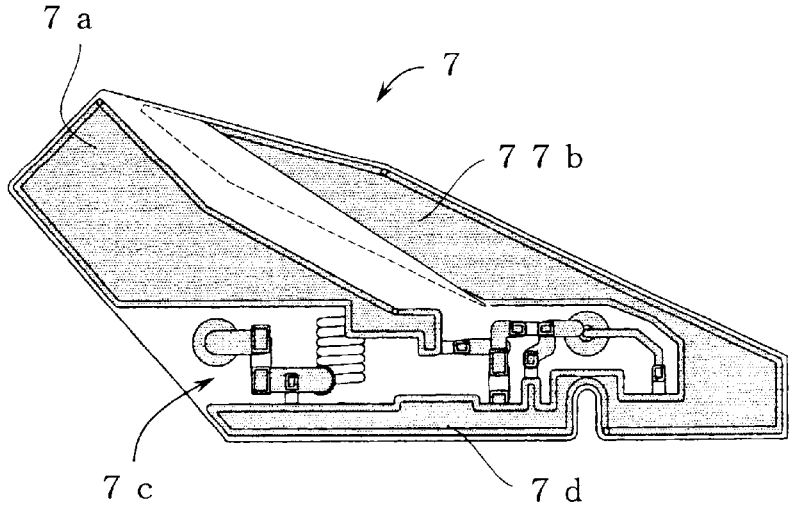
FIG. 45 is a diagram showing a composition wherein the shape of the passive element pattern has been changed in the antenna circuit board of a multi-frequency antenna according to an embodiment of the present invention.
Figure 46:
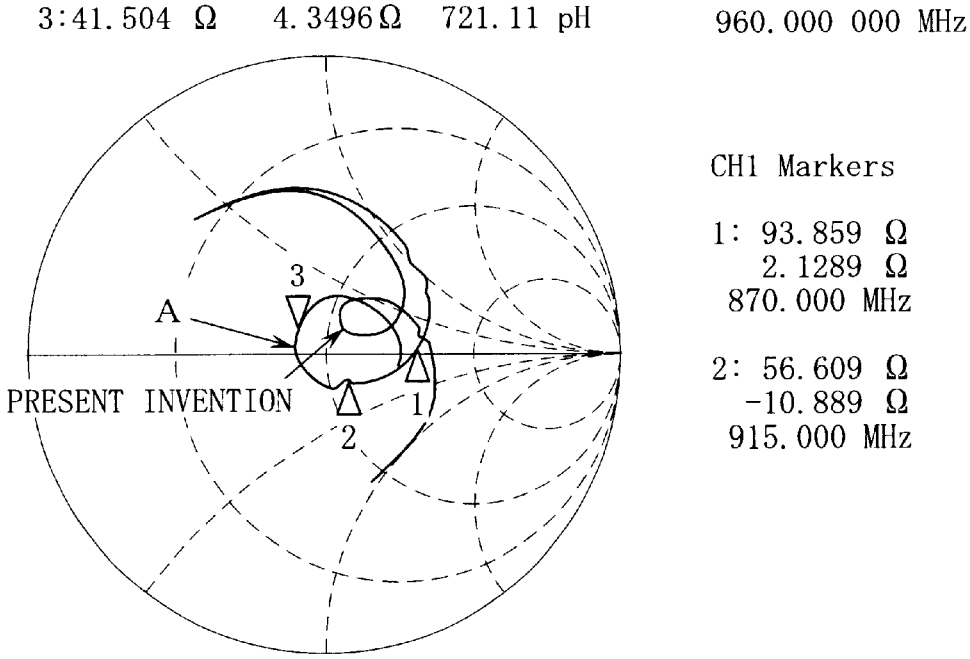
FIG. 46 is a Smith chart showing impedance characteristics in a GSM frequency band for a multi-frequency antenna according to an embodiment of the present invention, in a case where the shape of the passive element pattern in the antenna circuit board has been changed.
Figure 47:
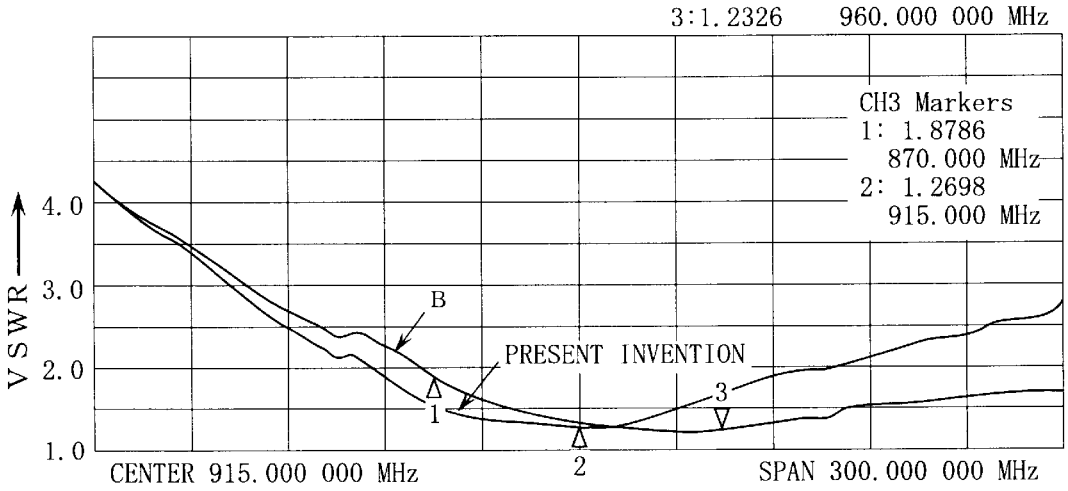
FIG. 47 is a diagram showing VSWR characteristics in a GSM frequency band for a multi-frequency antenna according to an embodiment of the present invention, in a case where the shape of the passive element pattern in the antenna circuit board has been changed.
Figure 48:
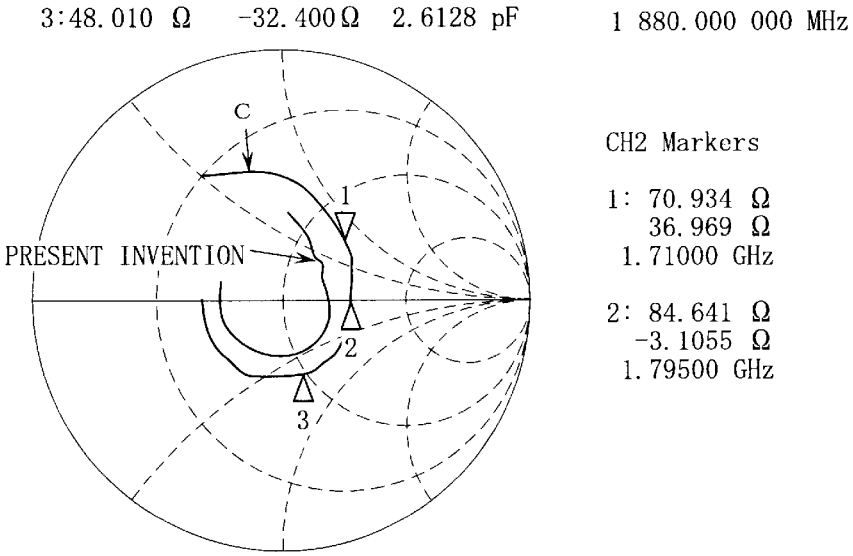
FIG. 48 is a Smith chart showing impedance characteristics in a DCS frequency band for a multi-frequency antenna according to an embodiment of the present invention, in a case where the shape of the passive element pattern in the antenna circuit board has been changed.
Figure 49:
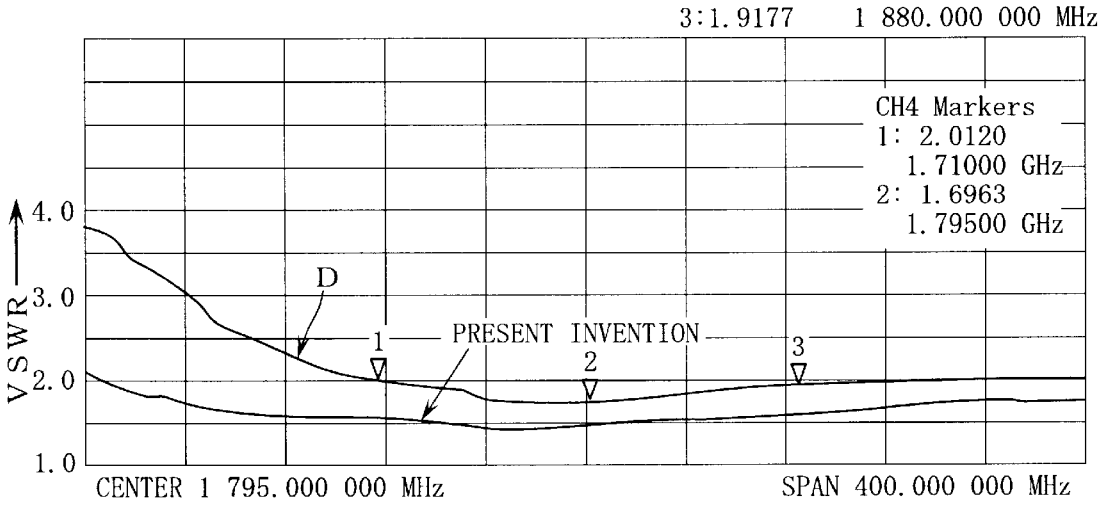
FIG. 49 is a diagram showing VSWR characteristics in a DCS frequency band for a multi-frequency antenna according to an embodiment of the present invention, in a case where the shape of the passive element pattern in the antenna circuit board has been changed.

Firstly, let it be assumed that the shape of the passive element pattern formed on the antenna circuit board 7 of the multi-frequency antenna 1 according to the present invention is changed as illustrated in FIG. 45. In FIG. 45, the portion of the passive element pattern 7*b* indicated by the broken lines is removed, thereby narrowing the width thereof, to form a passive element pattern 77*b* of a shape which has a greater interval from the antenna pattern 7*a*. FIGS. 46 to 49 show a comparison of antenna characteristics between a multi-frequency antenna 1 having the antenna circuit board 7 illustrated in FIG. 45, and a multi-frequency antenna 1 having the antenna circuit board 7 illustrated in FIG. 7 and FIG. 8. FIG. 46 shows impedance characteristics depicted by a Smith chart in the GSM frequency band, and FIG. 47 shows VSWR (Voltage Standing Wave Ratio) characteristics in the GSM frequency band. FIG. 48 shows impedance characteristics depicted by a Smith chart in the DCS frequency band, and FIG. 49 shows VSWR characteristics in the DCS frequency band. In FIG. 46 to FIG. 49, the antenna characteristics marked as "Present Invention" are characteristics for a case where the antenna circuit board 7 is constituted as illustrated in FIG. 7 and FIG. 8, and the antenna characteristics marked as "A"–"D" are characteristics for a case where the antenna circuit board 7 is constituted as illustrated in FIG. 45.

On observing these antenna characteristics, it can be seen that, in the GSM frequency band, when the shape of the antenna pattern is changed to that shown in FIG. 45, the antenna characteristics up to the central frequency thereof (Mark 2: 915 MHz) deteriorate, but above the central frequency, they eventually improve. However, in the DCS frequency band, if the shape of the antenna pattern is changed to that shown in FIG. 45, then antenna characteristics deteriorate across the entire frequency band.

Figure 50:
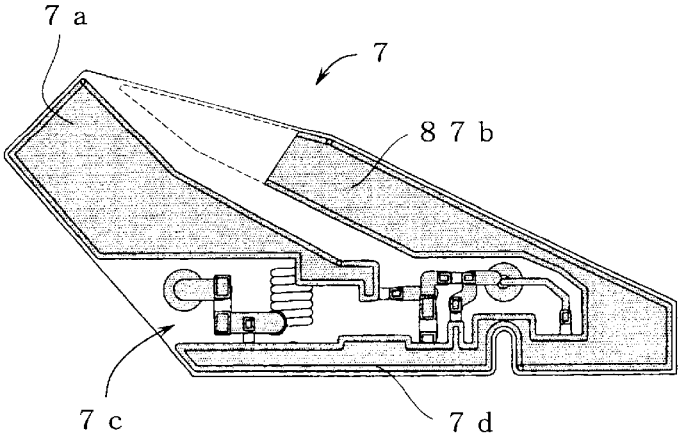
FIG. 50 is a diagram showing a further composition wherein the shape of the passive element pattern has been changed in the antenna circuit board of a multi-frequency antenna according to an embodiment of the present invention.
Figure 51:
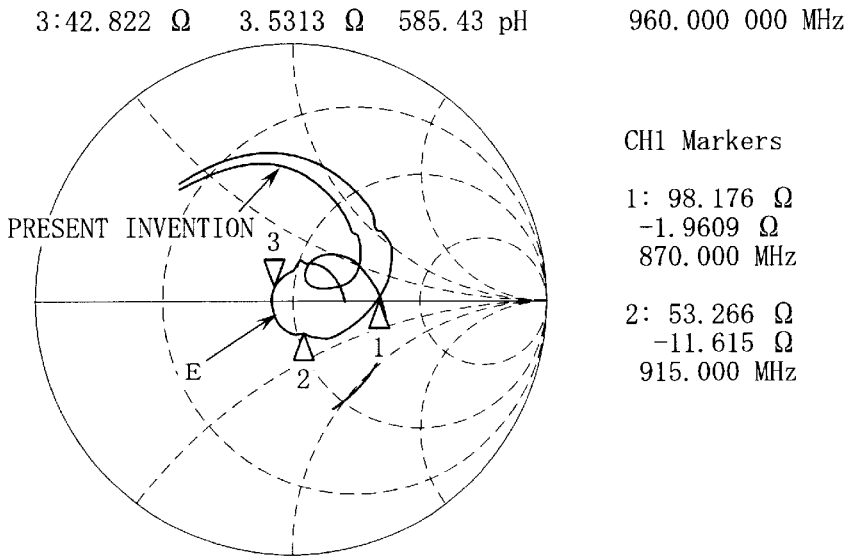
FIG. 51 is a Smith chart showing impedance characteristics in a GSM frequency band for a multi-frequency antenna according to an embodiment of the present invention, in a case where the shape of the passive element pattern in the antenna circuit board has been changed.
Figure 52:
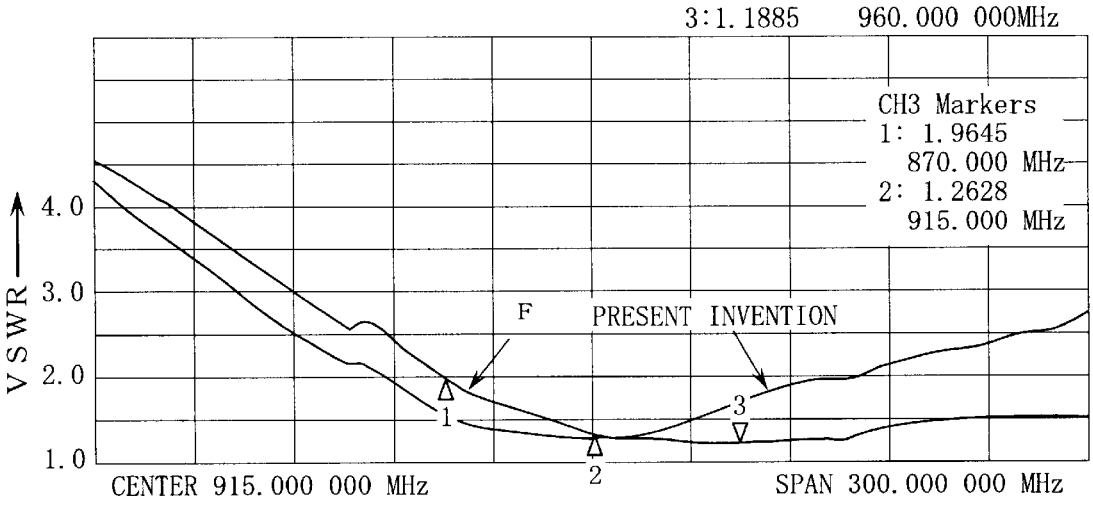
FIG. 52 is a diagram showing VSWR characteristics in a GSM frequency band for a multi-frequency antenna according to an embodiment of the present invention, in a case where the shape of the passive element pattern in the antenna circuit board has been changed.
Figure 53:
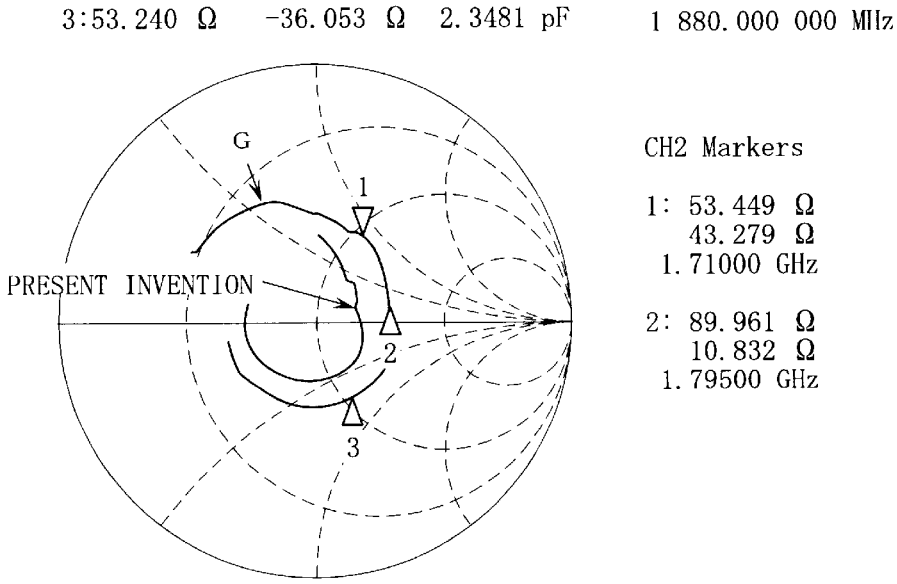
FIG. 53 is a Smith chart showing impedance characteristics in a DCS frequency band for a multi-frequency antenna according to an embodiment of the present invention, in a case where the shape of the passive element pattern in the antenna circuit board has been changed.
Figure 54:
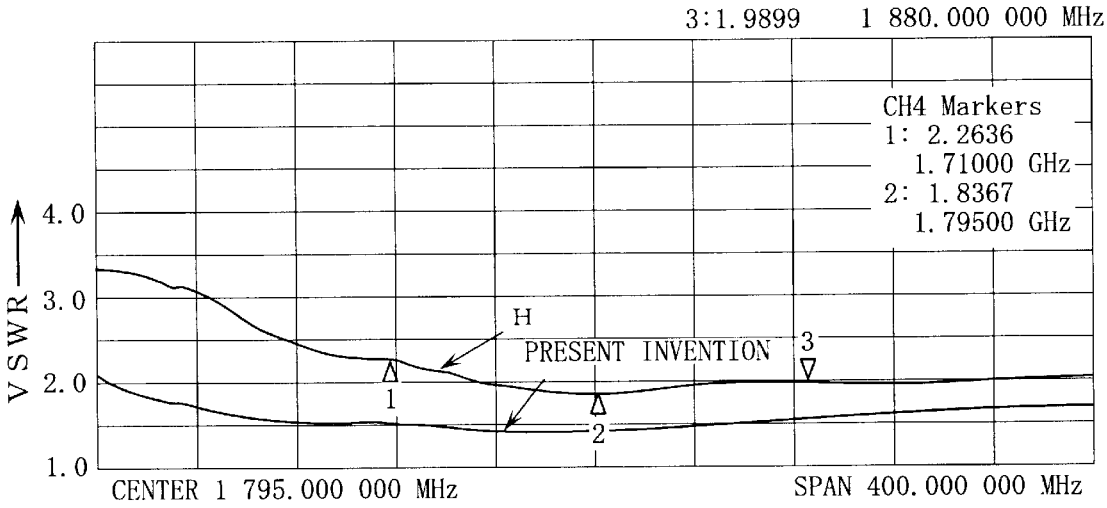
FIG. 54 is a diagram showing VSWR characteristics in a DCS frequency band for a multi-frequency antenna according to an embodiment of the present invention, in a case where the shape of the passive element pattern in the antenna circuit board has been changed.

Next, let it be assumed that the passive element pattern formed on the antenna circuit board 7 in the multi-frequency antenna 1 according to the present invention is changed as illustrated in FIG. 50. In FIG. 50, the front end portion of the passive element pattern 7*b* indicated by the broken lines is removed, thereby forming a passive element pattern 87*b* having a shorter overall length. FIGS. 51 to 54 show a comparison of antenna characteristics between a multi-frequency antenna 1 having the antenna circuit board 7 illustrated in FIG. 50, and a multi-frequency antenna 1 having the antenna circuit board 7 illustrated in FIG. 7 and FIG. 8. FIG. 51 shows impedance characteristics depicted by a Smith chart in the GSM frequency band, and FIG. 52 shows VSWR (Voltage Standing Wave Ratio) characteristics in the GSM frequency band. FIG. 53 shows impedance characteristics depicted by a Smith chart in the DCS frequency band, and FIG. 54 shows VSWR characteristics in the DCS frequency band. In FIG. 46 to FIG. 49, the antenna characteristics marked as "Present Invention" are characteristics for a case where the antenna circuit board 7 is constituted as illustrated in FIG. 7 and FIG. 8, and the antenna characteristics marked as "E"–"H" are characteristics for a case where the antenna circuit board 7 is constituted as illustrated in FIG. 50.

On observing these antenna characteristics, it can be seen that, in the GSM frequency band, when the shape of the antenna pattern is changed to that shown in FIG. 50, the antenna characteristics up to the central frequency thereof (Mark 2: 915 MHz) deteriorate, but above the central frequency, they eventually improve. However, in the DCS frequency band, if the shape of the antenna pattern is changed to that shown in FIG. 50, then antenna characteristics deteriorate across the entire frequency band.

Therefore, by changing the shape of the passive element pattern, it is possible to adjust the antenna characteristics of the lower frequency band and the higher frequency band of the GSM band in opposite directions, and moreover, it is possible to adjust antenna characteristics for the whole DCS frequency band. with the shape of the passive element pattern 7*b* illustrated in FIG. 7 and FIG. 8, optimal antenna characteristics are obtained in both the DCS frequency band and the GSM frequency band.

Next, the antenna characteristics of the multi-frequency antenna 1 in a case where the passive element pattern formed on the antenna circuit board 7 has the shape illustrated in FIG. 7 and FIG. 8 will be described.

Figure 9:
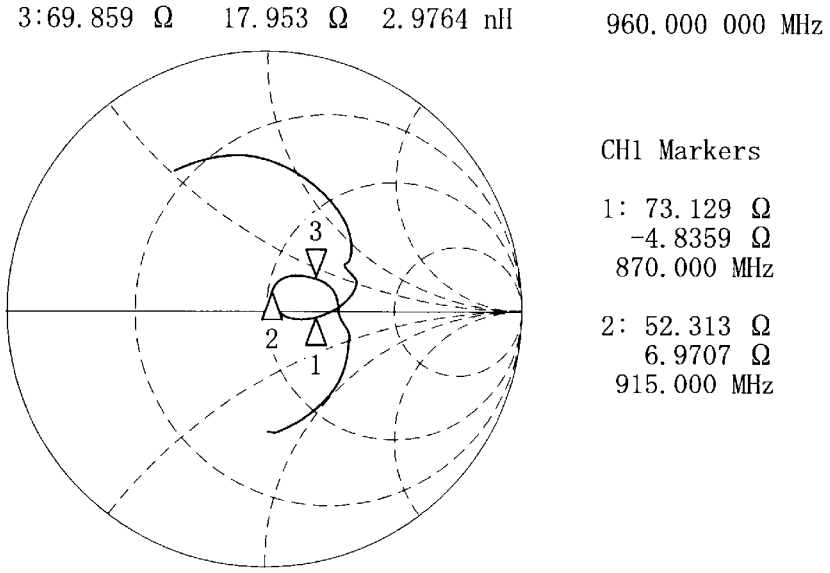
FIG. 9 is a Smith chart showing impedance characteristics in a GSM frequency band of a multi-frequency antenna according to an embodiment of the present invention.
Figure 10:
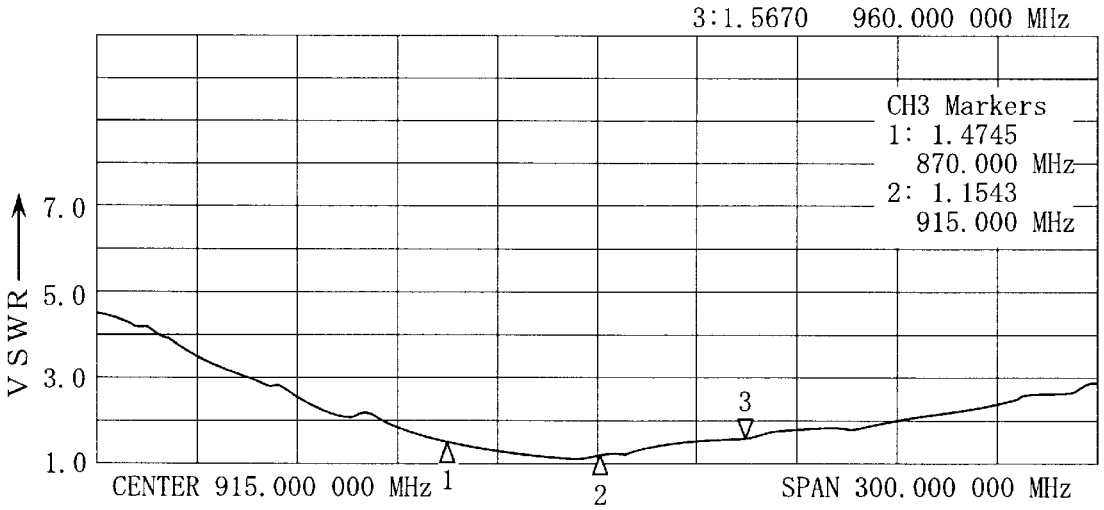
FIG. 10 is a diagram showing VSWR characteristics in a GSM frequency band of a multi-frequency antenna according to an embodiment of the present invention.
Figure 11:
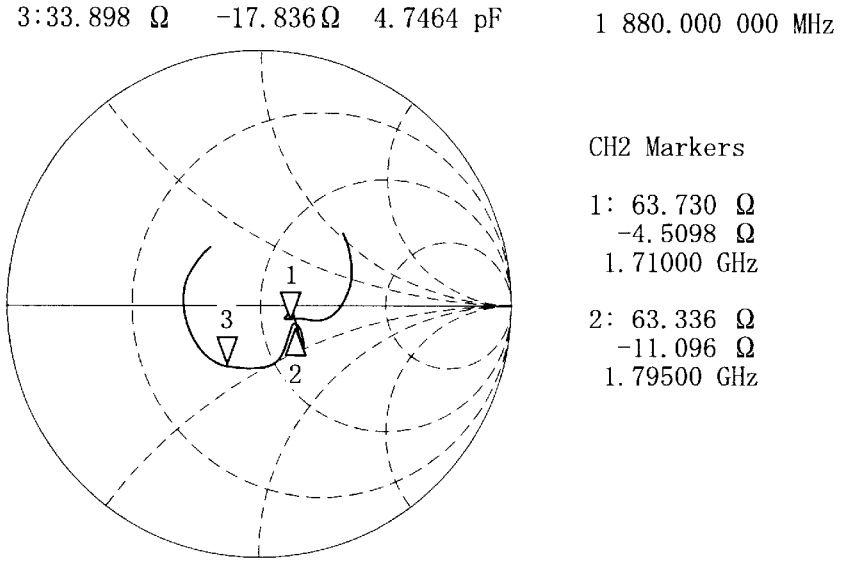
FIG. 11 is a Smith chart showing impedance characteristics in a DCS frequency band of a multi-frequency antenna according to an embodiment of the present invention.
Figure 12:
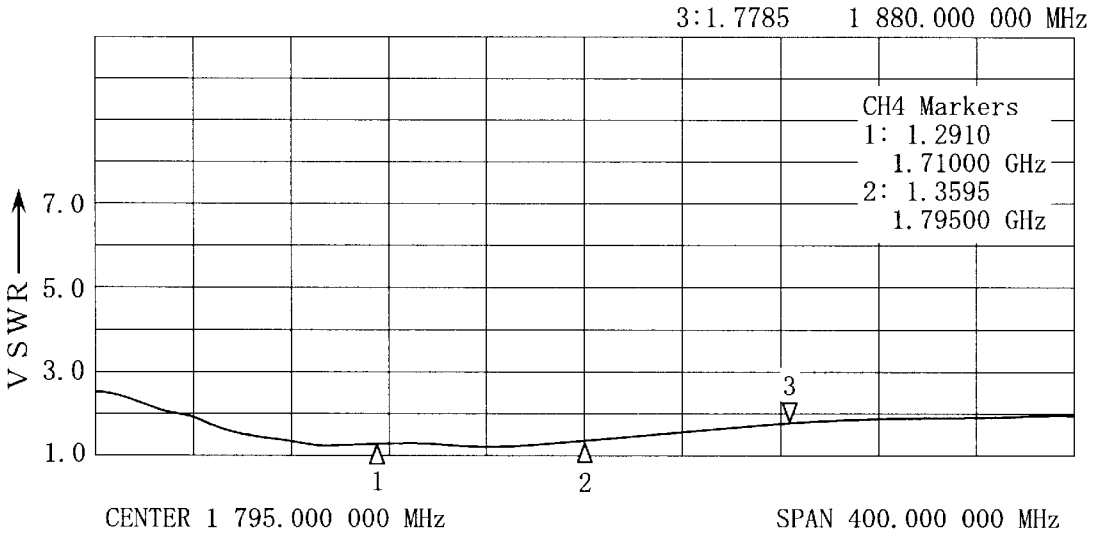
FIG. 12 is a diagram showing VSWR characteristics in a DCS frequency band of a multi-frequency antenna according to an embodiment of the present invention.

FIG. 9 to FIG. 12 show the antenna characteristics of the multi-frequency antenna 1 in the case of an antenna circuit board 7 as illustrated in FIG. 7 and FIG. 8. FIG. 9 shows impedance characteristics depicted on a Smith chart in the GSM frequency band, and FIG. 10 shows VSWR characteristics in the GSM frequency band. Moreover, FIG. 11 shows impedance characteristics depicted on a Smith chart in the DCS frequency band and FIG. 12 shows VSWR characteristics in the DCS frequency band. Observing these antenna characteristics, it can be seen that in the 870 MHz–960 MHz GSM frequency band, a best VSWR value of approximately 1.1 and a worst VSWR value of approximately 1.47 are obtained, and hence good impedance characteristics are achieved. Moreover in the 1.71 GHz–1.88 GHz DCS frequency band, a best VSWR value of approximately 1.2 and a worst VSWR value of approximately 1.78 were obtained, and hence good impedance characteristics are achieved.

The antenna characteristics shown in FIG. 9 to FIG. 12 are antenna characteristics in the case of antenna incorporating an HPF 20 and LPF 21 having the circuit composition shown in FIG. 6, in which case the values for the various elements of the HPF 20 and LPF 21 are as follows. In the HPF 20, the capacitors C1, C2 are approximately 3 pF, the capacitor C3 is approximately 0.5 pF, and the inductor L1 is approximately 15 nH, whilst in the LPF 21, the inductor L2 is a hollow coil of approximately 30 nH, the inductor L3 is 0.12 $\mu$H and the capacitor C4 is approximately 13 pF.

Figure 13:
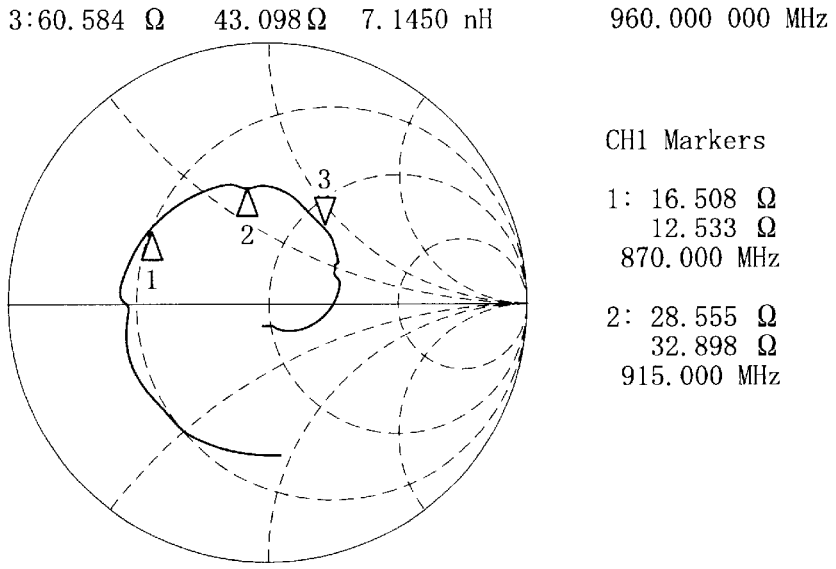
FIG. 13 is a Smith chart showing impedance characteristics in a GSM frequency band of a multi-frequency antenna according to an embodiment of the present invention, in a case where the matching circuit is removed.
Figure 14:
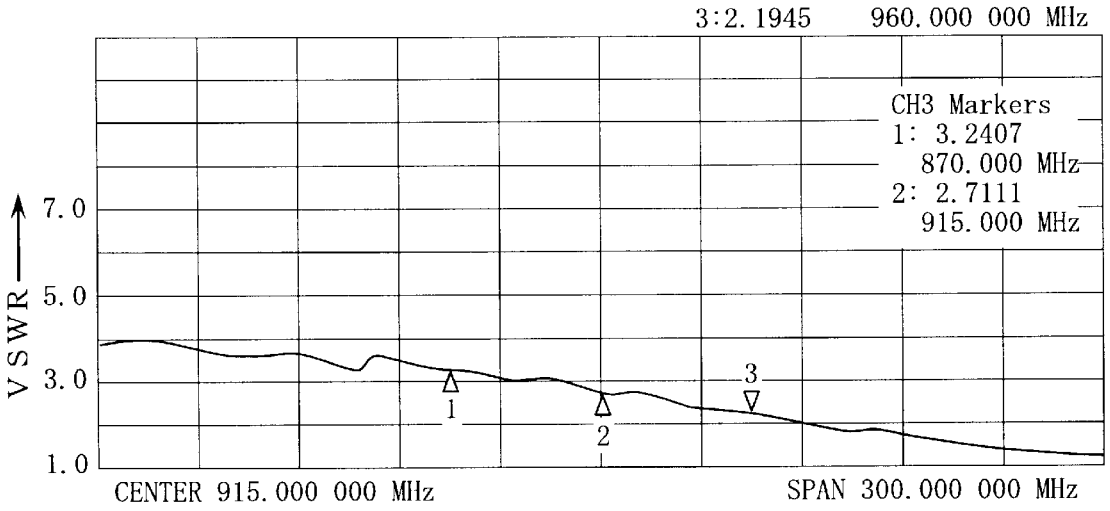
FIG. 14 is a diagram showing VSWR characteristics in a GSM frequency band of a multi-frequency antenna according to an embodiment of the present invention, in a case where the matching circuit is removed.
Figure 15:
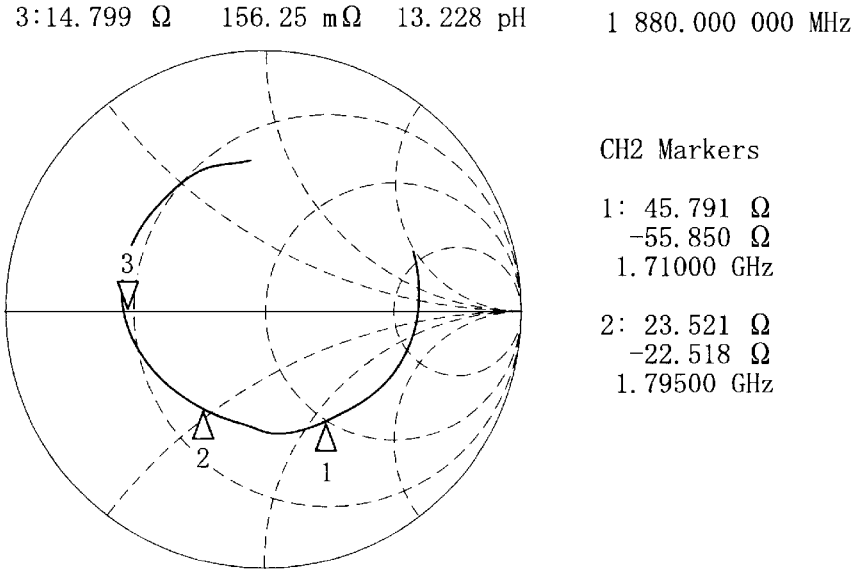
FIG. 15 is a Smith chart showing impedance characteristics in a DCS frequency band of a multi-frequency antenna according to an embodiment of the present invention, in a case where the matching circuit is removed.
Figure 16:
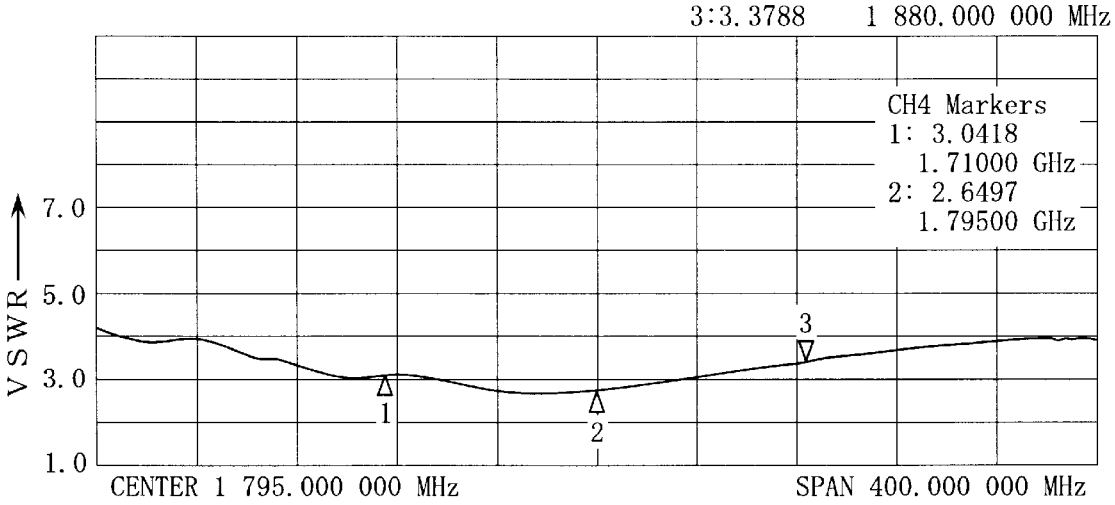
FIG. 16 is a diagram showing VSWR characteristics in a DCS frequency band of a multi-frequency antenna according to an embodiment of the present invention, in a case where the matching circuit is removed.

As described above, the HPF 20 incorporates a matching circuit and in order to describe the action of this matching circuit, FIG. 13 to FIG. 16 show antenna characteristics in a case where the LPF 21 and HPF 20 shown in FIG. 6 (including capacitor C3) are removed. FIG. 13 shows impedance characteristics depicted on a Smith chart in the GSM frequency band, and FIG. 14 shows VSWR characteristics in the GSM frequency band. Moreover, FIG. 15 shows impedance characteristics depicted on a Smith chart in the DCS frequency band and FIG. 16 shows VSWR characteristics in the DCS frequency band. Observing these antenna characteristics, it can be seen that in the 870 MHz–960 MHz GSM frequency band, the impedance characteristics are degraded in such a manner that a best VSWR value of approximately 2.19 and a worst VSWR value of approximately 3.24 are obtained. Moreover in the 1.71 GHz–1.88 GHz DCS frequency band, it can be seen that the impedance characteristics are degraded in such a manner that a best VSWR value of approximately 2.6 and a worst VSWR value of approximately 3.38 are obtained.

Therefore, it can be seen that by removing the matching circuit in this manner, antenna characteristics are degraded in both the GSM and DCS frequency bands.

Figure 17:
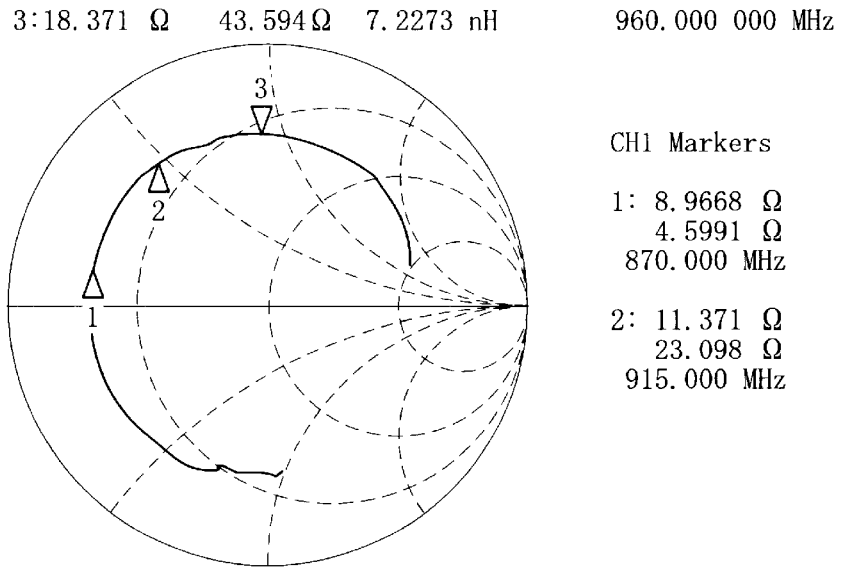
FIG. 17 is a Smith chart showing impedance characteristics in a GSM frequency band of a multi-frequency antenna according to an embodiment of the present invention, in a case where the matching circuit and passive element pattern is removed.
Figure 18:
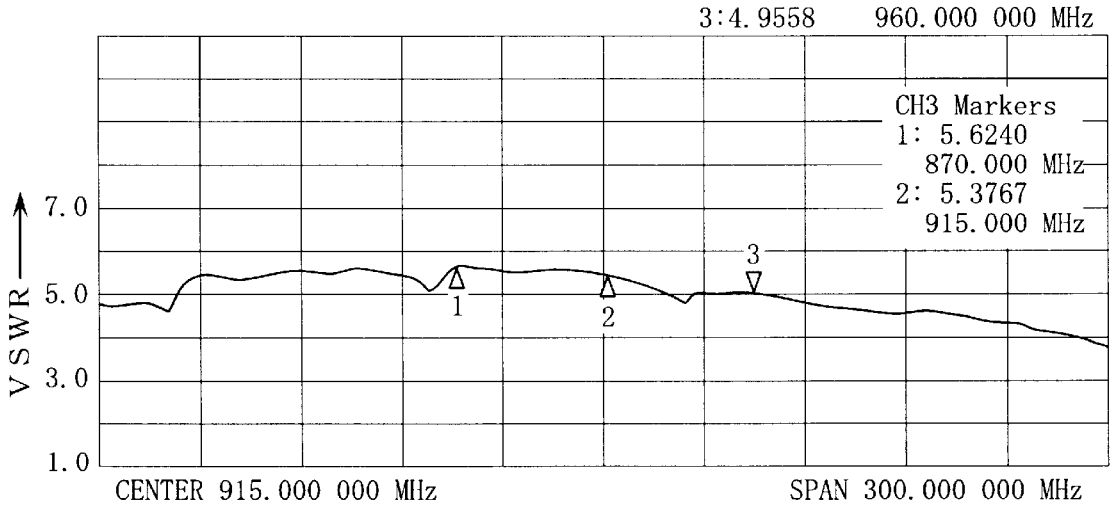
FIG. 18 is a diagram showing VSWR characteristics in a GSM frequency band of a multi-frequency antenna according to an embodiment of the present invention, in a case where the matching circuit and passive element pattern is removed.
Figure 19:
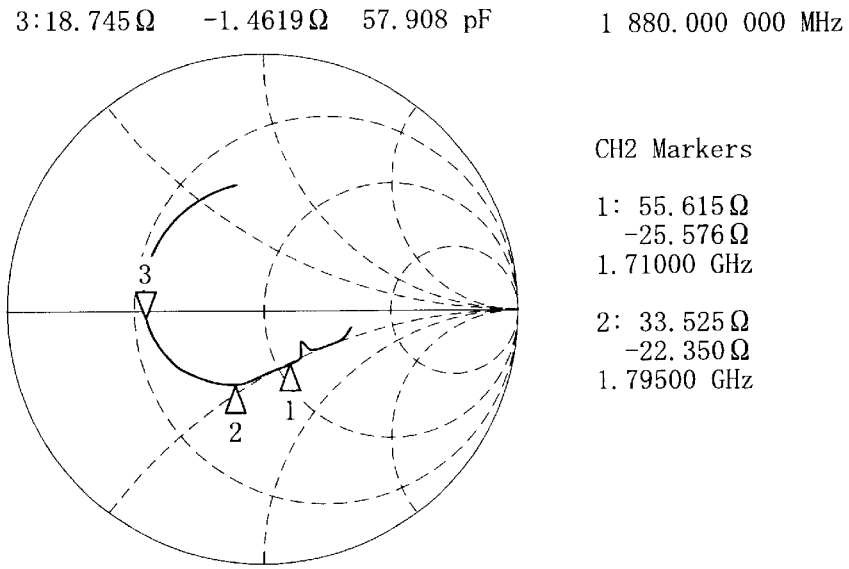
FIG. 19 is a Smith chart showing impedance characteristics in a DCS frequency band of a multi-frequency antenna according to an embodiment of the present invention, in a case where the matching circuit and passive element pattern is removed.
Figure 20:
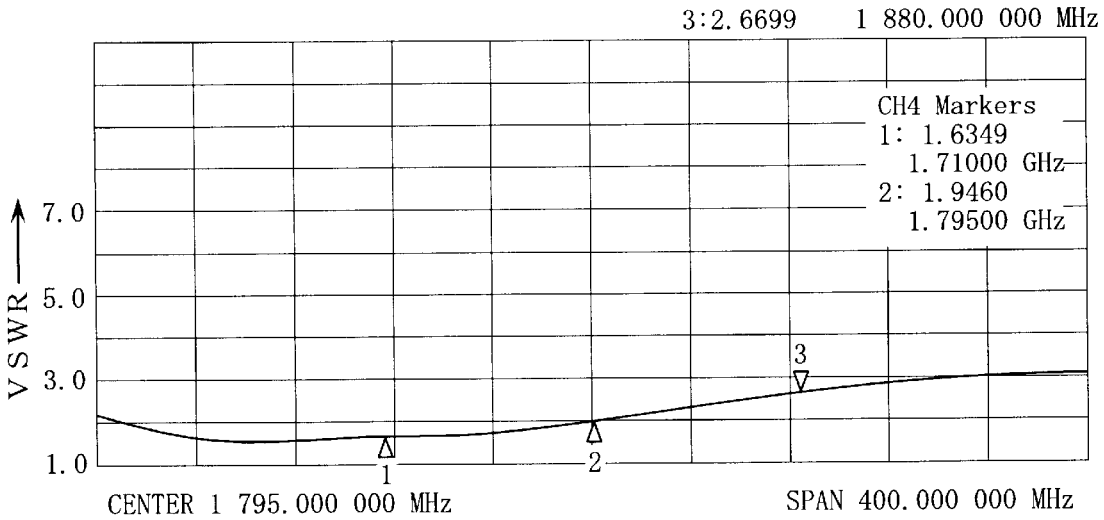
FIG. 20 is a diagram showing VSWR characteristics in a DCS frequency band of a multi-frequency antenna according to an embodiment of the present invention, in a case where the matching circuit and passive element pattern is removed.

Next, in order to describe the action of the passive element pattern 7*b* for the purpose of reference, FIG. 17 to FIG. 20 illustrate antenna characteristics in a case where the passive element pattern 7*b*, and the LPF 21 and HPF 20 (including capacitor C3) shown in FIG. 6 are removed. FIG. 17 shows impedance characteristics depicted on a Smith chart in the GSM frequency band, and FIG. 18 shows VSWR characteristics in the GSM frequency band. Moreover, FIG. 19 shows impedance characteristics depicted on a Smith chart in the DCS frequency band and FIG. 20 shows VSWR characteristics in the DCS frequency band. Observing these antenna characteristics, it can be seen that in the 870 MHz–960 MHz GSM frequency band, the impedance characteristics are greatly degraded in such a manner that a best VSWR value of approximately 4.8 and a worst VSWR value of approximately 5.62 are obtained. Moreover in the 1.71 GHz–1.88 GHz DCS frequency band, it can be seen that the impedance characteristics are degraded in such a manner that a best VSWR value of approximately 1.6 and a worst VSWR value of approximately 2.67 are obtained.

Therefore, it can be seen that by removing the passive element pattern 7*b* and the matching circuit in this manner, antenna characteristics are degraded in the GSM frequency band in particular.

Next, the vertical-plane radiation pattern and horizontal-plane radiation pattern of the multi-frequency antenna 1 according to the present invention in the DCS frequency band and the GSM frequency band are illustrated in FIG. 22 to FIG. 44.

Figure 21:
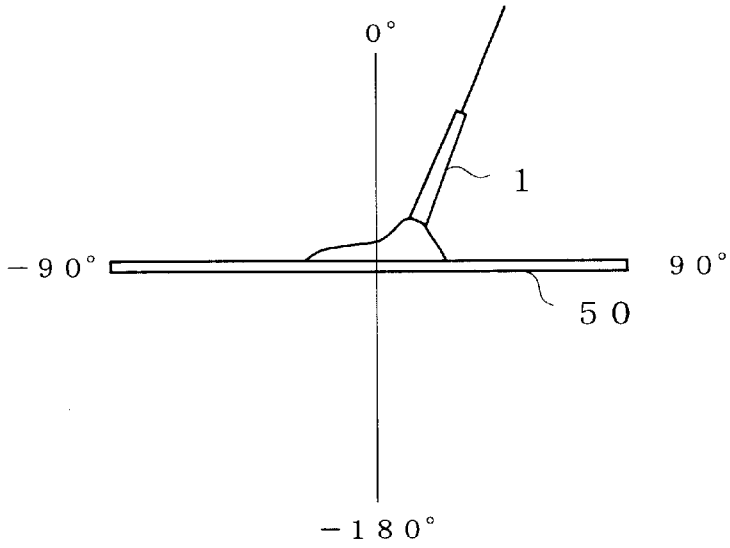
FIG. 21 is a diagram showing the state of a multi-frequency antenna according to an embodiment of the present invention for measurement of vertical-plane radiation pattern.
Figure 22:
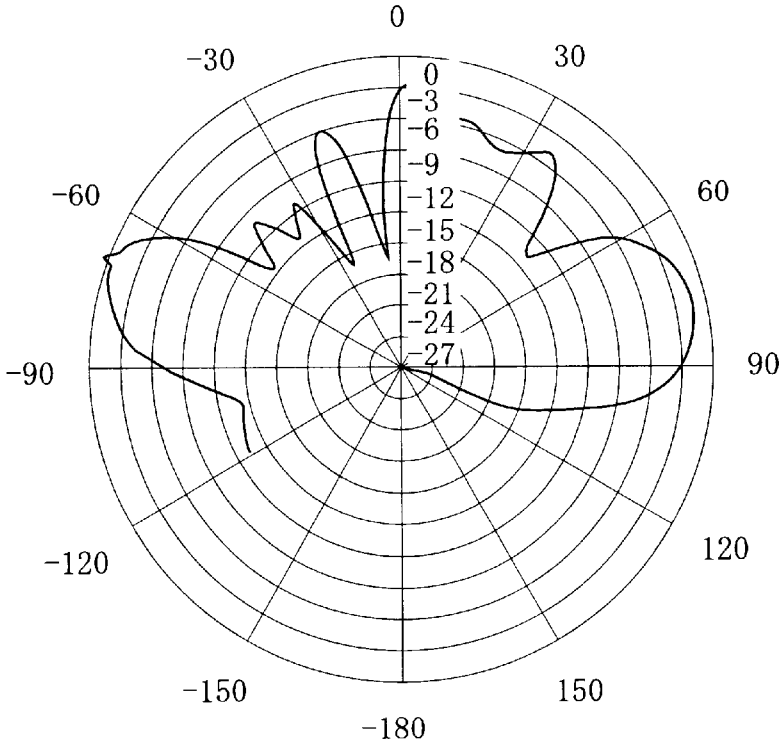
FIG. 22 is a diagram showing vertical-plane radiation pattern at 1710 MHz for a multi-frequency antenna according to an embodiment of the present invention.
Figure 23:
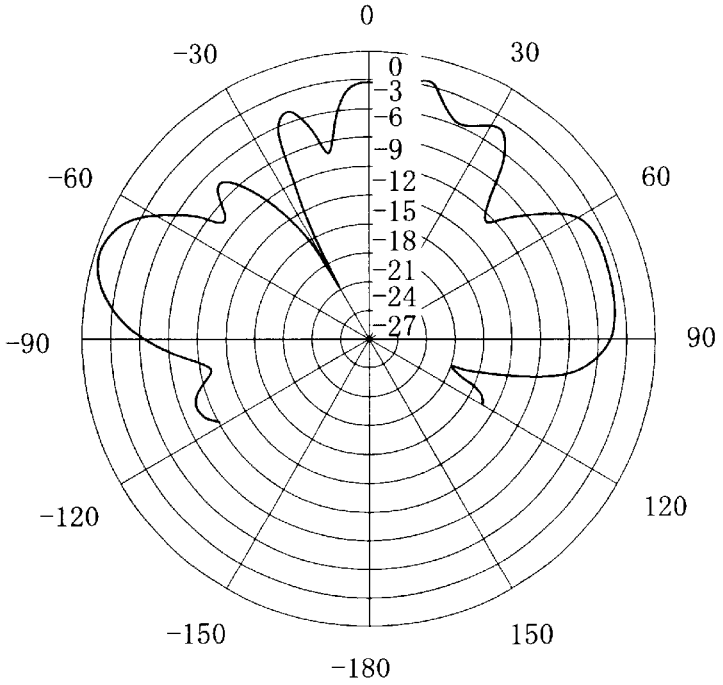
FIG. 23 is a diagram showing vertical-plane radiation pattern at 1795 MHz for a multi-frequency antenna according to an embodiment of the present invention.
Figure 24:
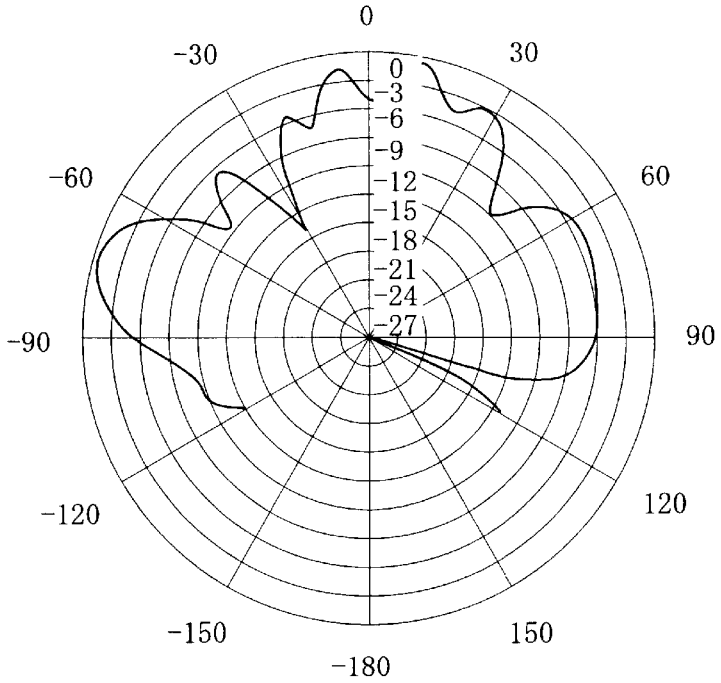
FIG. 24 is a diagram showing vertical-plane radiation pattern at 1880 MHz for a multi-frequency antenna according to an embodiment of the present invention.

The vertical-plane radiation pattern shown in FIG. 22 to FIG. 24 are vertical-plane radiation pattern in the DCS frequency band as viewed from the side for a multi-frequency antenna 1 which is installed on a ground plane 50 of approximately 1 m diameter, as illustrated in FIG. 21, and the angle of elevation and angle of inclination thereof are as illustrated in FIG. 21. FIG. 22 shows vertical-plane radiation pattern at 1710 MHz which is the lowest frequency in the DCS band, and it depicts concentric circles at intervals of −3 dB. Observing these directionality characteristics, large gain is obtained in the ±60°–±90° direction and in the direction of the zenith. The antenna gain in this case is a high gain of approximately +2.55 dB, compared to a ½ wavelength dipole antenna.

FIG. 23 shows vertical-plane radiation pattern at 1795 MHz, which is the central frequency of the DCS band, and it depicts concentric circles at intervals of −3 dB. Observing these directionality characteristics, the gain falls in the vicinity of −30° and in the vicinity of 45°, but good directionality characteristics are obtained in the 100°–−100° direction. In this case, the antenna gain is a high gain of approximately +1.82 dB compared to a ½ wavelength dipole antenna.

FIG. 24 shows vertical-plane radiation pattern at 1880 MHz, which is the highest frequency of the DCS band, and it depicts concentric circles at intervals of −3 dB. Observing these directionality characteristics, the gain falls in the vicinity of −30° and in the vicinity of 45°, but good directionality characteristics are obtained in the 100°–−100° direction. In this case, the antenna gain is a high gain of approximately +1.98 dB compared to a ½ wavelength dipole antenna.

Figure 25:
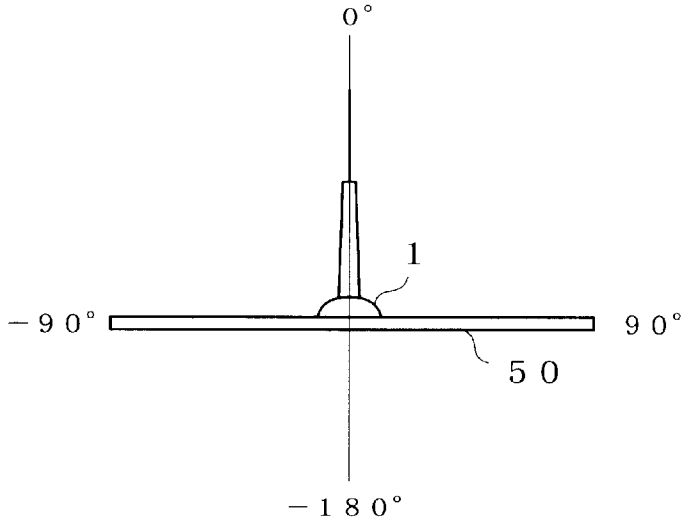
FIG. 25 is a diagram showing the state of a multi-frequency antenna according to an embodiment of the present invention for measurement of vertical-plane radiation pattern.
Figure 26:
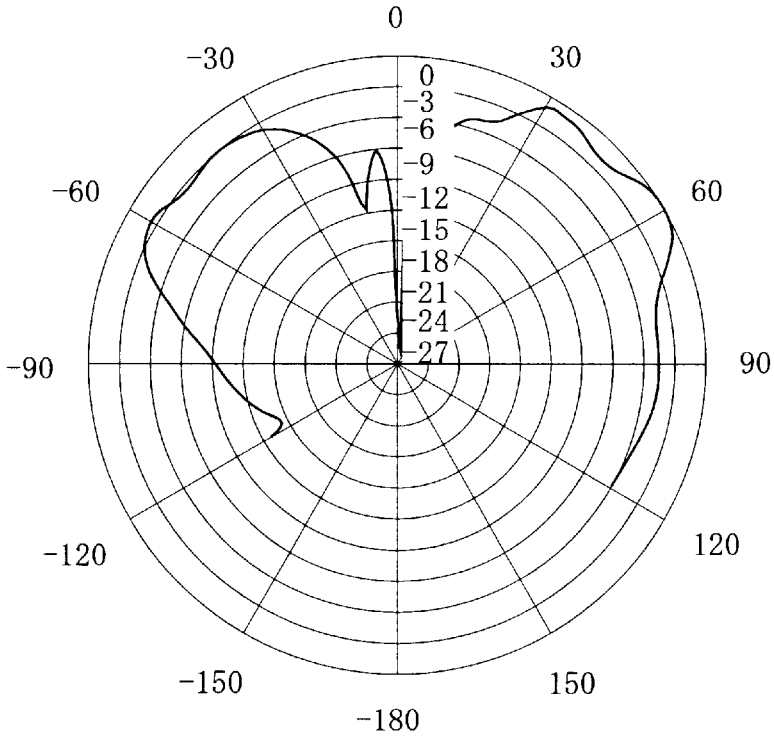
FIG. 26 is a diagram showing vertical-plane radiation pattern at 1710 MHz for a multi-frequency antenna according to an embodiment of the present invention.
Figure 27:
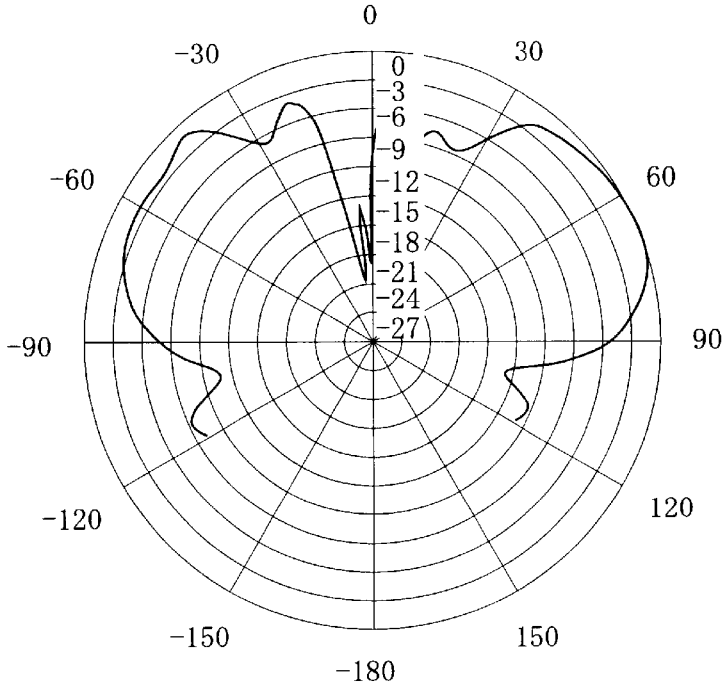
FIG. 27 is a diagram showing vertical-plane radiation pattern at 1795 MHz for a multi-frequency antenna according to an embodiment of the present invention.
Figure 28:
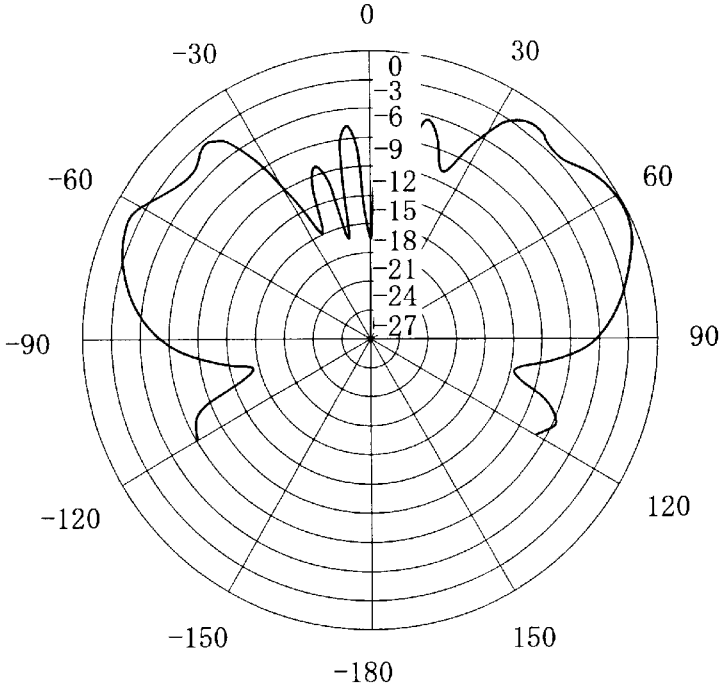
FIG. 28 is a diagram showing vertical-plane radiation pattern at 1880 MHz for a multi-frequency antenna according to an embodiment of the present invention.

The vertical-plane radiation pattern shown in FIG. 26 to FIG. 28 are vertical-plane radiation pattern in the DCS frequency band as viewed from the front for a multi-frequency antenna 1 which is installed on a ground plane 50 of approximately 1 m diameter, as illustrated in FIG. 25, and the angle of elevation and angle of inclination thereof are as illustrated in FIG. 25. FIG. 26 shows vertical-plane radiation pattern at 1710 MHz which is the lowest frequency in the DCS band, and it depicts concentric circles at intervals of −3 dB. Observing these directionality characteristics, the gain falls in the vicinity of −90° direction and in the direction of the zenith, but good directionality characteristics are obtained in the direction of approximately 100°—75°. The antenna gain in this case is a high gain of approximately −4.33 dB, compared to a ½ wavelength dipole antenna.

FIG. 27 shows vertical-plane radiation pattern at 1795 MHz which is the central frequency in the DCS band, and it depicts concentric circles at intervals of −3 dB. Observing these directionality characteristics, the gain falls in the vicinity of −90° direction and in the direction of the zenith, but good directionality characteristics are obtained in the direction of approximately 90°—80°. The antenna gain in this case is a high gain of approximately −1.9 dB, compared to a ½ wavelength dipole antenna.

FIG. 28 shows vertical-plane radiation pattern at 1880 MHz which is the highest frequency in the DCS band, and it depicts concentric circles at intervals of −3 dB. Observing these directionality characteristics, the gain falls in the vicinity of −90° direction and in the direction of the zenith, but good directionality characteristics are obtained in the direction of approximately 90°—80°. The antenna gain in this case is a high gain of approximately −1.59 dB, compared to a ½ wavelength dipole antenna.

Figure 29:
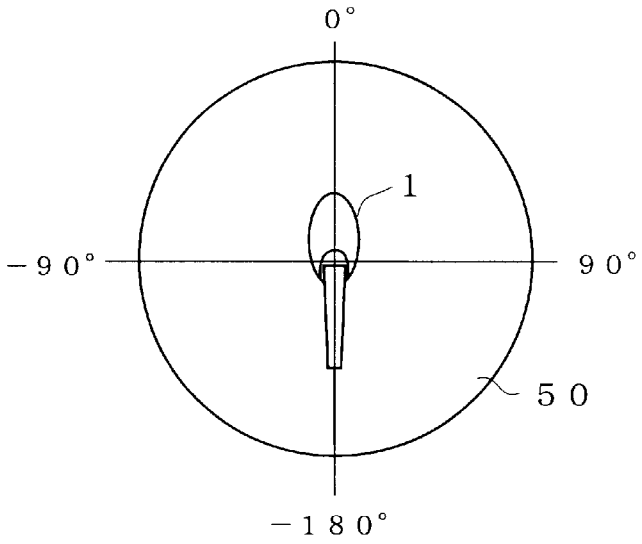
FIG. 29 is a diagram showing the state of a multi-frequency antenna according to an embodiment of the present invention for measurement of horizontal-plane radiation pattern.
Figure 30:
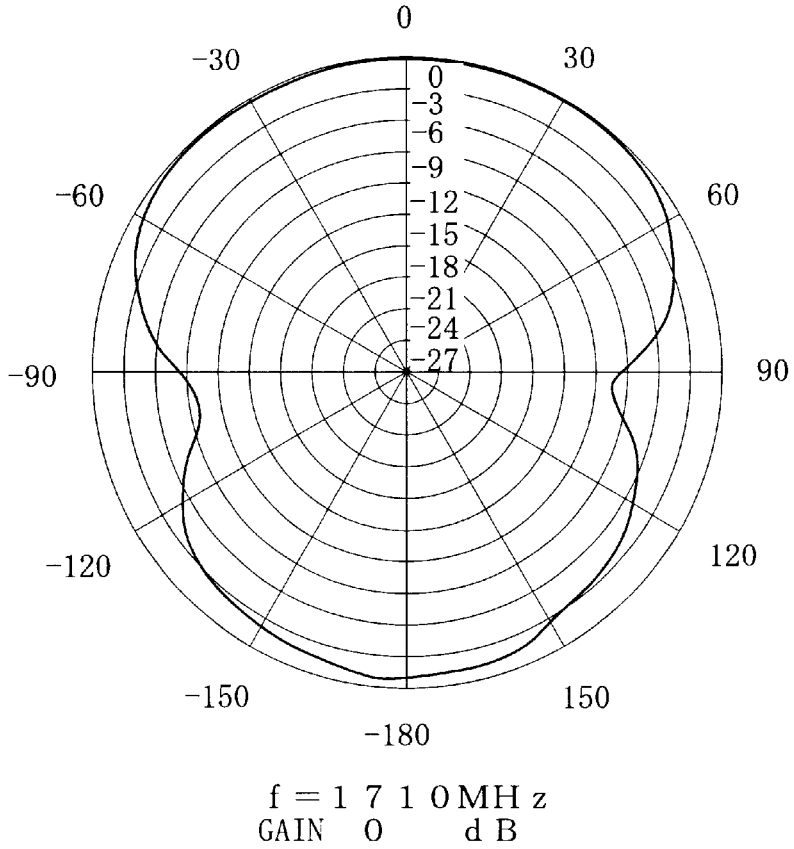
FIG. 30 is a diagram showing horizontal-plane radiation pattern at 1710 MHz for a multi-frequency antenna according to an embodiment of the present invention.
Figure 31:
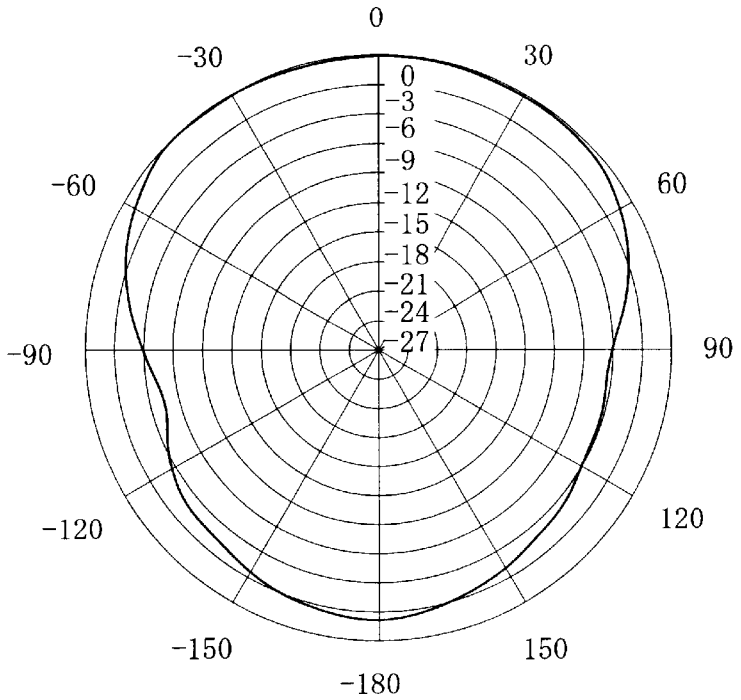
FIG. 31 is a diagram showing horizontal-plane radiation pattern at 1795 MHz for a multi-frequency antenna according to an embodiment of the present invention.
Figure 32:
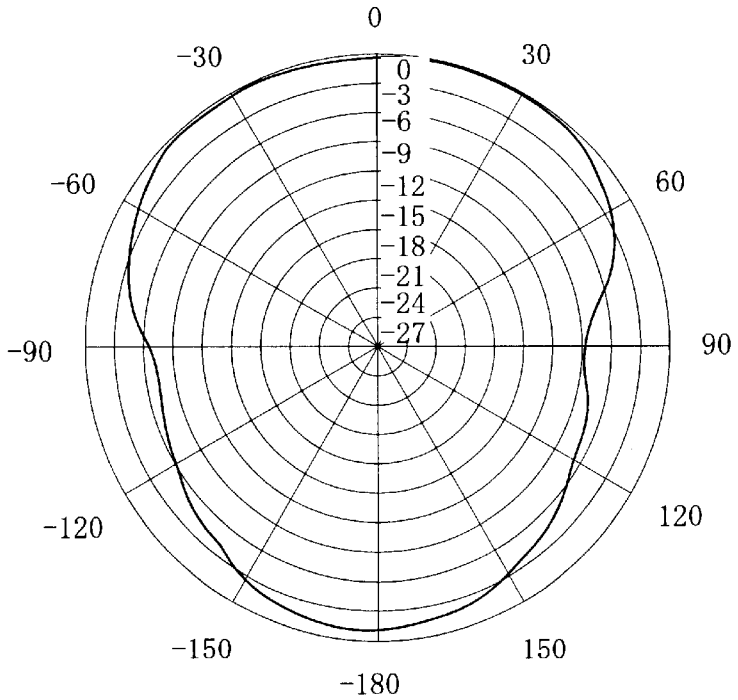
FIG. 32 is a diagram showing horizontal-plane radiation pattern at 1880 MHz for a multi-frequency antenna according to an embodiment of the present invention.

The horizontal-plane radiation pattern shown in FIG. 30 to FIG. 32 are horizontal-plane radiation pattern in the DCS frequency band for a multi-frequency antenna 1 which is installed on a ground plane 50 of approximately 1 m diameter, as illustrated in FIG. 29, and the angle thereof is taken as an angle of 0° in the forward direction, as illustrated in FIG. 29. FIG. 30 shows horizontal-plane radiation pattern at 1710 MHz which is the lowest frequency in the DCS band, and it depicts concentric circles at intervals of −3 dB. Observing these directionality characteristics, the gain falls in the vicinity of −100° and in the vicinity of 90°, but good directionality characteristics which are practically omnidirectional are obtained. The antenna gain in this case is approximately 0 dB, compared to a ¼ wavelength whip antenna.

FIG. 31 shows horizontal-plane radiation pattern at 1795 MHz which is the central frequency in the DCS band, and it depicts concentric circles at intervals of −3 dB. Observing these directionality characteristics, the gain falls in the vicinity of −100° and in the vicinity of 90°—120°, but good directionality characteristics which are practically omnidirectional are obtained. The antenna gain in this case is approximately −0.83 dB, compared to a ¼ wavelength whip antenna.

FIG. 32 shows horizontal-plane radiation pattern at 1880 MHz which is the highest frequency in the DCS band, and it depicts concentric circles at intervals of −3 dB. Observing these directionality characteristics, the gain falls in the vicinity of −90° to −120° C. and in the vicinity of 80° to 120°, but good directionality characteristics which are practically omnidirectional are obtained. The antenna gain in this case is approximately −0.51 dB, compared to a ¼ wavelength whip antenna.

Figure 33:
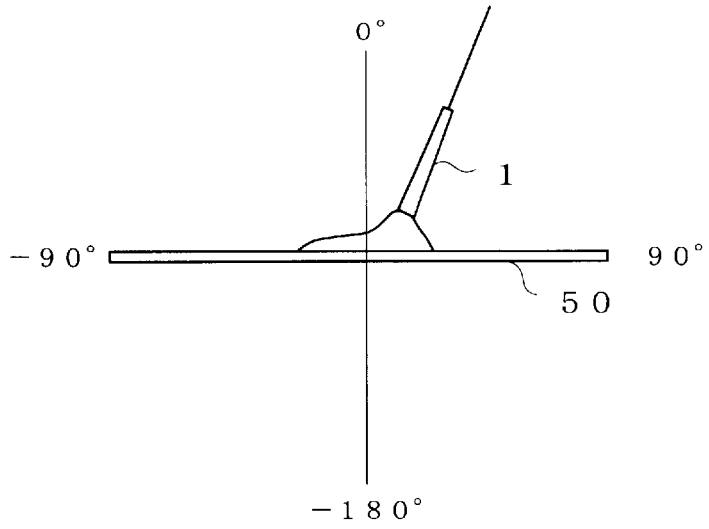
FIG. 33 is a diagram showing the state of a multi-frequency antenna according to an embodiment of the present invention for measurement of vertical-plane radiation pattern.
Figure 34:
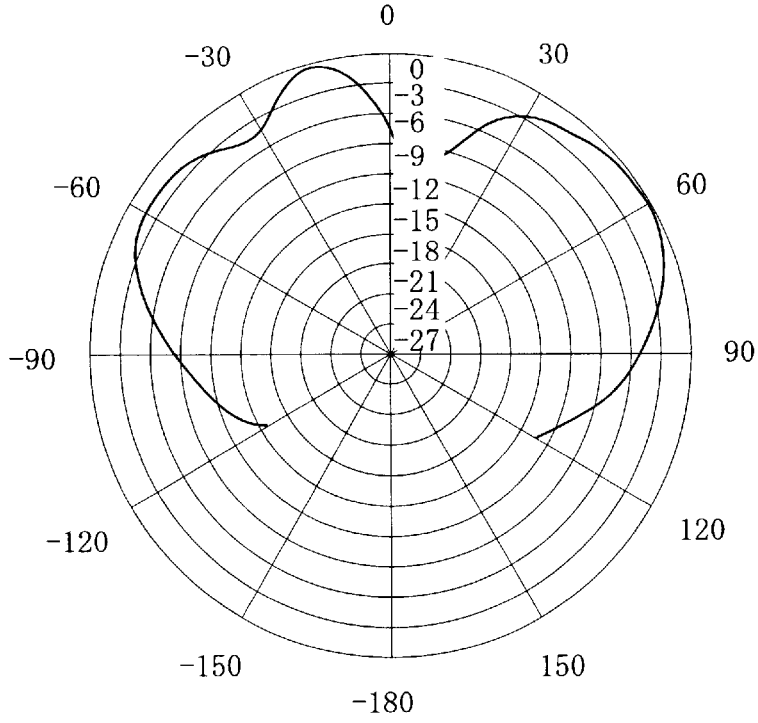
FIG. 34 is a diagram showing vertical-plane radiation pattern at 870 MHz for a multi-frequency antenna according to an embodiment of the present invention.
Figure 35:
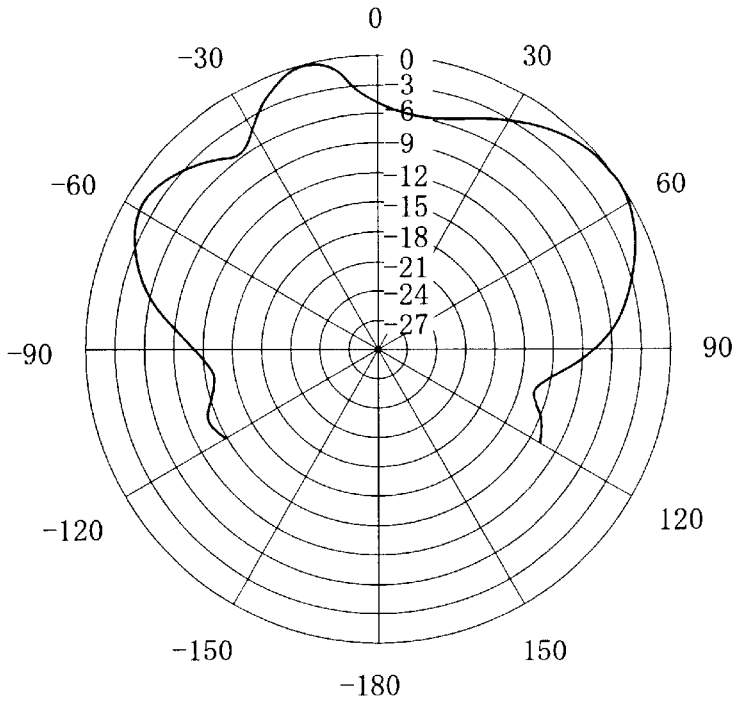
FIG. 35 is a diagram showing vertical-plane radiation pattern at 915 MHz for a multi-frequency antenna according to an embodiment of the present invention.
Figure 36:
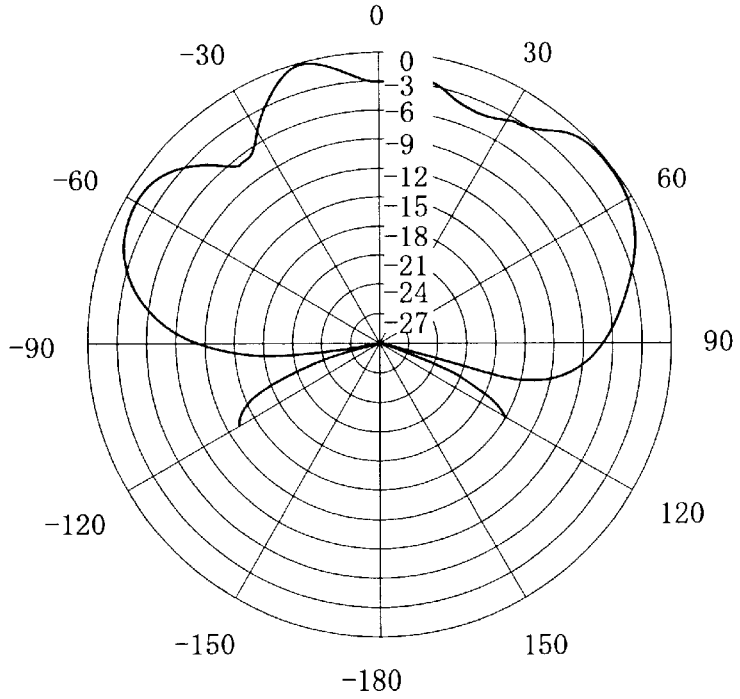
FIG. 36 is a diagram showing vertical-plane radiation pattern at 960 MHz for a multi-frequency antenna according to an embodiment of the present invention.

The vertical-plane radiation pattern shown in FIG. 34 to FIG. 36 are vertical-plane radiation pattern in the GSM frequency band as viewed from the side for a multi-frequency antenna 1 which is installed on a ground plane 50 of approximately 1 m diameter, as illustrated in FIG. 33, and the angle of elevation and angle of inclination thereof are as illustrated in FIG. 33. FIG. 34 shows vertical-plane radiation pattern at 870 MHz which is the lowest frequency in the GSM band, and it depicts concentric circles at intervals of −3 dB. Observing these directionality characteristics, the gain falls in the vicinity of 10° and in the vicinity of −90°, but good gain is obtained in the direction of 90° to −80°. The antenna gain in this case is approximately −0.15 dB, compared to a ½ wavelength dipole antenna.

FIG. 35 shows vertical-plane radiation pattern at 915 MHz, which is the central frequency of the GSM band, and it depicts concentric circles at intervals of −3 dB. Observing these directionality characteristics, the gain falls in the direction of −80° and below and in the vicinity of 90°, but good directionality characteristics are obtained in the direction of 80° to −75°. In this case, the antenna gain is approximately +0.8 dB compared to a ½ wavelength dipole antenna.

FIG. 36 shows vertical-plane radiation pattern at 960 MHz, which is the highest frequency of the GSM band, and it depicts concentric circles at intervals of −3 dB. Observing these directionality characteristics, the gain falls in the direction of −80° and below and in the vicinity of 90°, but good directionality characteristics are obtained in the direction of 85° to −80°. In this case, the antenna gain is approximately −0.47 dB compared to a ½ wavelength dipole antenna.

Figure 37:
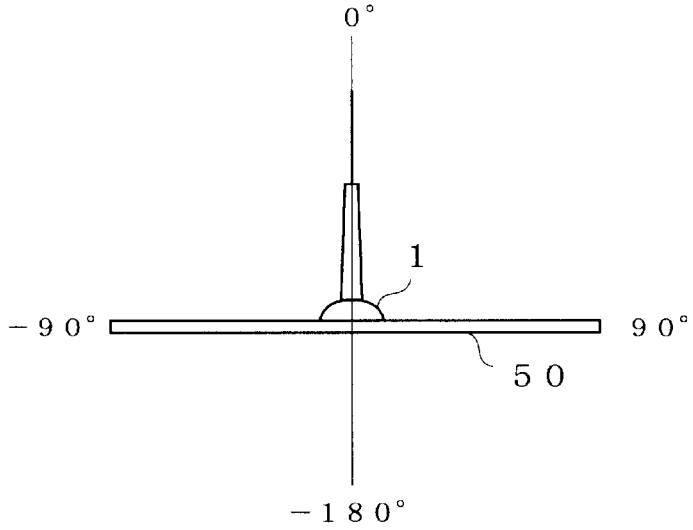
FIG. 37 is a diagram showing the state of a multi-frequency antenna according to an embodiment of the present invention for measurement of vertical-plane radiation pattern.
Figure 38:
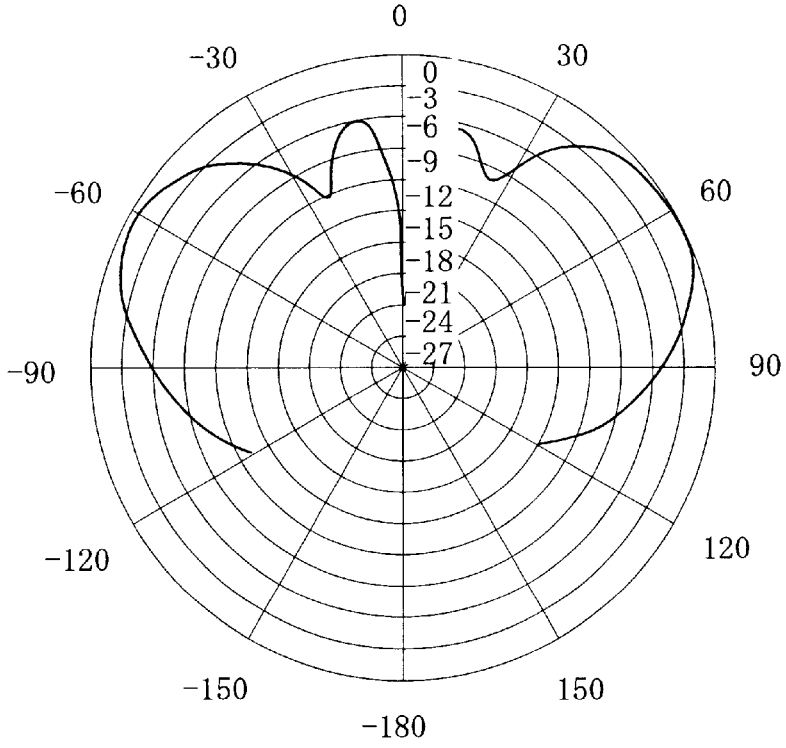
FIG. 38 is a diagram showing vertical-plane radiation pattern at 870 MHz for a multi-frequency antenna according to an embodiment of the present invention.
Figure 39:
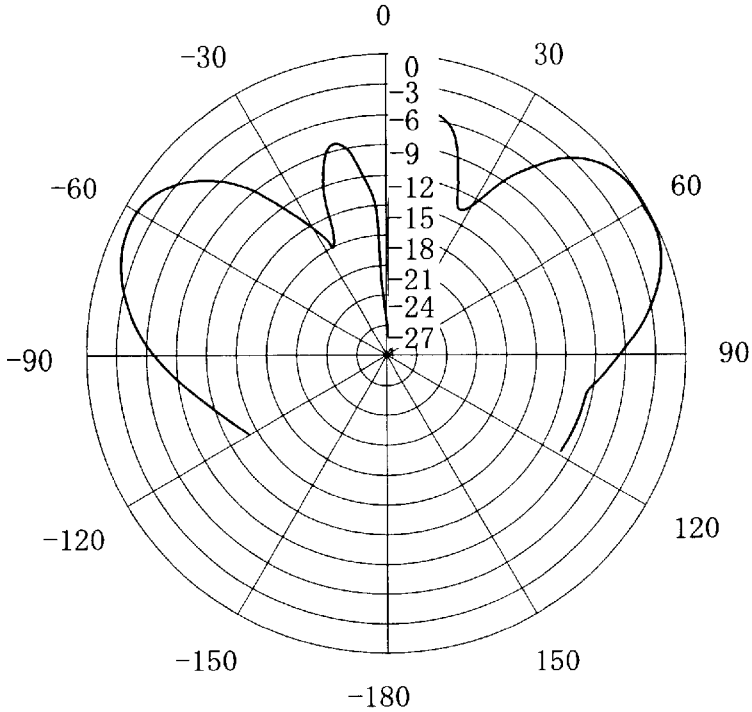
FIG. 39 is a diagram showing vertical-plane radiation pattern at 915 MHz for a multi-frequency antenna according to an embodiment of the present invention.
Figure 40:
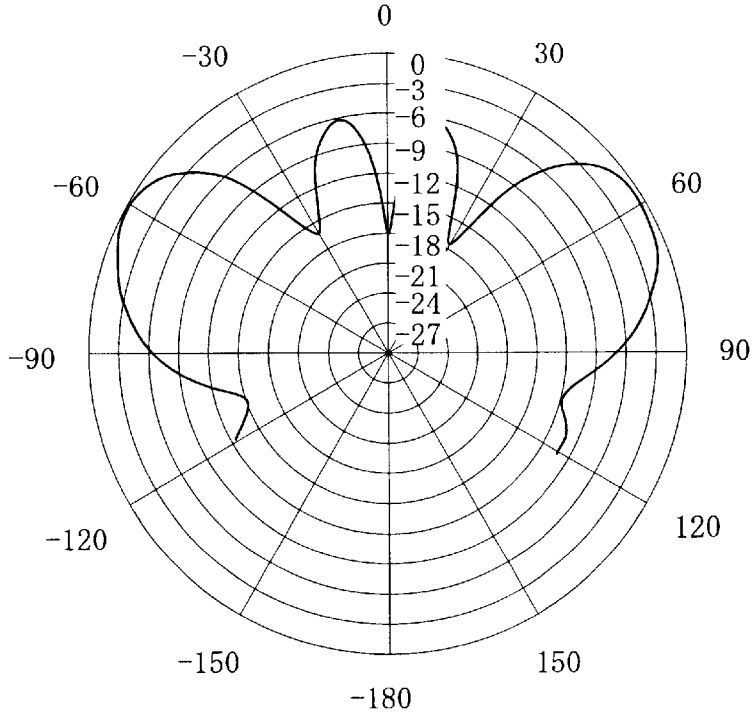
FIG. 40 is a diagram showing vertical-plane radiation pattern at 960 MHz for a multi-frequency antenna according to an embodiment of the present invention.

The vertical-plane radiation pattern shown in FIG. 38 to FIG. 40 are vertical-plane radiation pattern in the GSM frequency band as viewed from the front for a multi-frequency antenna 1 which is installed on a ground plane 50 of approximately 1 m diameter, as illustrated in FIG. 37, and the angle of elevation and angle of inclination thereof are as illustrated in FIG. 37. FIG. 38 shows vertical-plane radiation pattern at 870 MHz which is the lowest frequency in the GSM band, and it depicts concentric circles at intervals of −3 dB. Observing these directionality characteristics, the gain falls in the vicinity of −20°, the vicinity of the zenith and the vicinity of 20°, but good directionality characteristics are obtained in the direction of approximately 90° to −90°. The antenna gain in this case is approximately −0.01 dB, compared to a ½ wavelength dipole antenna.

FIG. 39 shows vertical-plane radiation pattern at 915 MHz which is the central frequency in the GSM band, and it depicts concentric circles at intervals of −3 dB. Observing these directionality characteristics, the gain falls in the vicinity of −30°, the vicinity of the zenith and the vicinity of 30°, but good directionality characteristics are obtained in the direction of approximately 90° to −90°. The antenna gain in this case is approximately +1.24 dB, compared to a ½ wavelength dipole antenna.

FIG. 40 shows vertical-plane radiation pattern at 960 MHz which is the highest frequency in the GSM band, and it depicts concentric circles at intervals of −3 dB. Observing these directionality characteristics, the gain falls in the vicinity of −30°, the vicinity of the zenith and the vicinity of 30°, but good directionality characteristics are obtained in the direction of approximately 90° to −90°. The antenna gain in this case is a high gain of approximately +1.21 dB, compared to a ½ wavelength dipole antenna.

Figure 41:
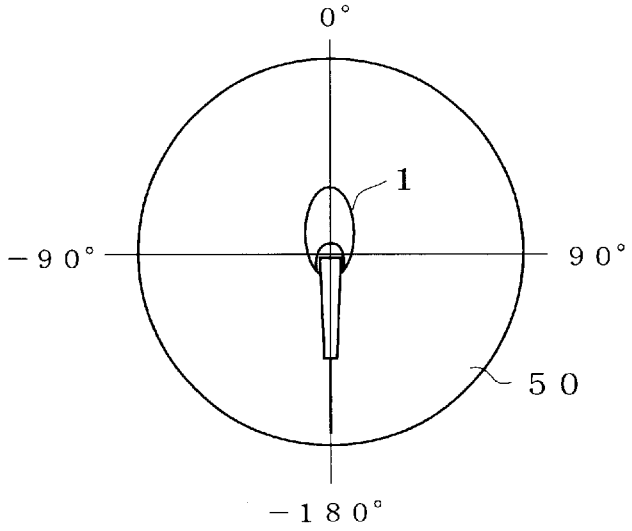
FIG. 41 is a diagram showing the state of a multi-frequency antenna according to an embodiment of the present invention for measurement of horizontal-plane radiation pattern.
Figure 42:
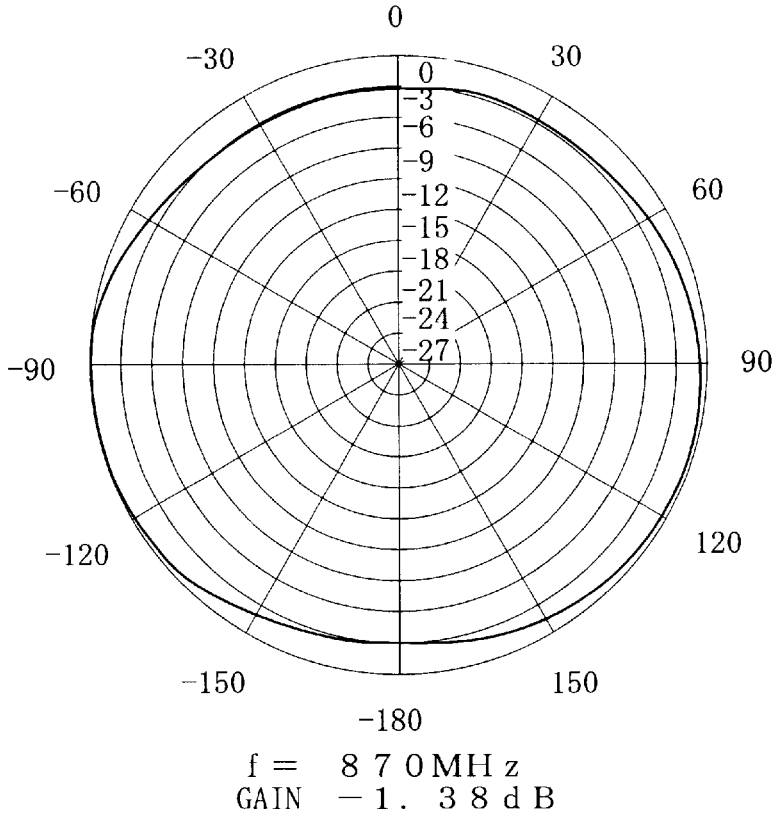
FIG. 42 is a diagram showing horizontal-plane radiation pattern at 870 MHz for a multi-frequency antenna according to an embodiment of the present invention.
Figure 43:
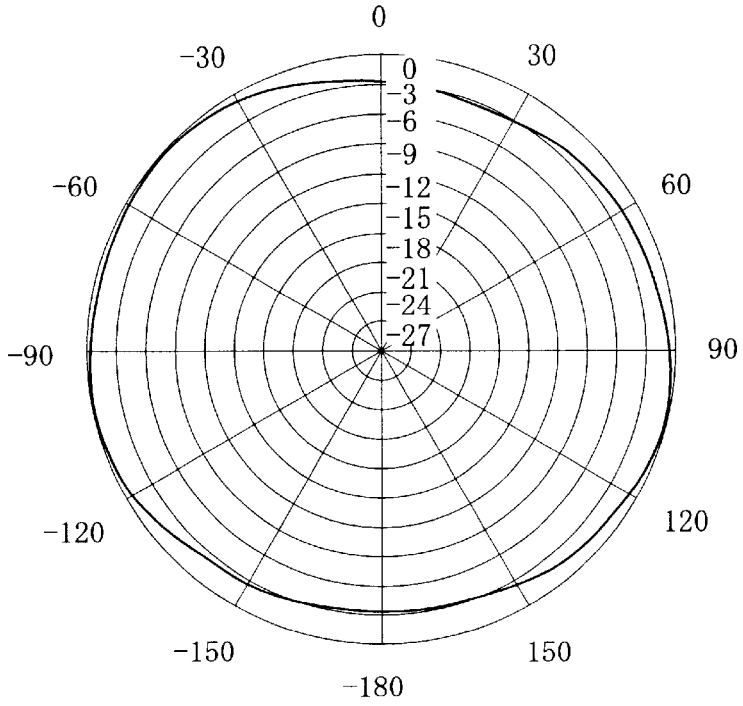
Figure 44:
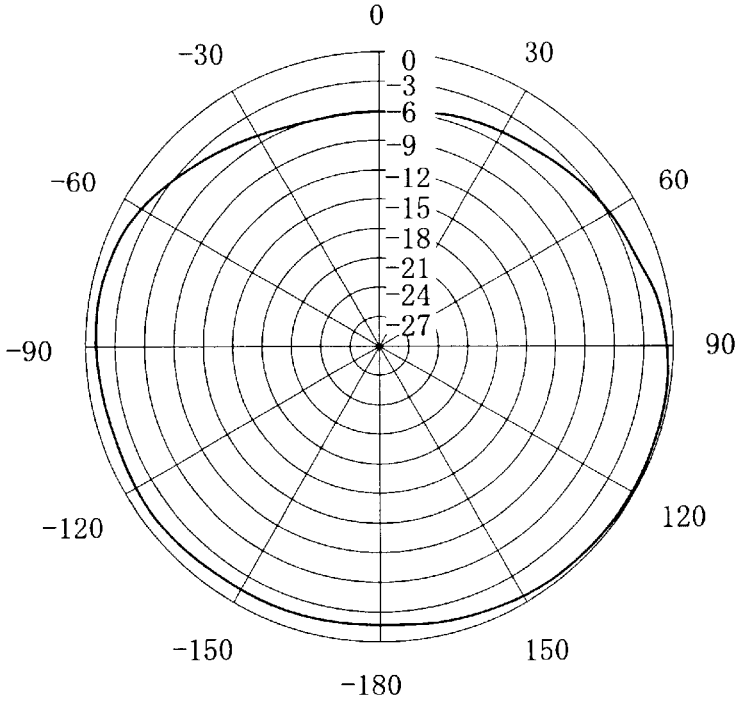
FIG. 44 is a diagram showing horizontal-plane radiation pattern at 960 MHz for a multi-frequency antenna according to an embodiment of the present invention.

The horizontal-plane radiation pattern shown in FIG. 42 to FIG. 44 are horizontal-plane radiation pattern in the GSM frequency band for a multi-frequency antenna 1 which is installed on a ground plane 50 of approximately 1 m diameter, as illustrated in FIG. 41, and the angle thereof is taken as an angle of 0° in the forward direction, as illustrated in FIG. 41. FIG. 42 shows horizontal-plane radiation pattern at 870 MHz which is the lowest frequency in the GSM band, and it depicts concentric circles at intervals of −3 dB. Observing these directionality characteristics, the gain falls slightly in the vicinity of 0° and in the vicinity of −180°, but good directionality characteristics which are practically omnidirectional are obtained. The antenna gain in this case is approximately −1.38 dB, compared to a ¼ wavelength whip antenna.

FIG. 43 shows horizontal-plane radiation pattern at 915 MHz which is the central frequency in the GSM band, and it depicts concentric circles at intervals of −3 dB. Observing these directionality characteristics, good directionality characteristics which are practically omnidirectional are obtained. The antenna gain in this case is approximately −1.13 dB, compared to a ¼ wavelength whip antenna.

FIG. 44 shows horizontal-plane radiation pattern at 960 MHz which is the highest frequency in the GSM band, and it depicts concentric circles at intervals of −3 dB. Observing these directionality characteristics, the gain falls in the vicinity of 0° C., but good directionality characteristics which are practically omnidirectional are obtained. The antenna gain in this case is approximately −1.43 dB, compared to a ¼ wavelength whip antenna.

By observing these vertical-plane radiation pattern, it can be seen that a large gain can be obtained practically at a low angle of elevation in the D-net and E-net frequency bands, and hence a multi-frequency antenna 1 which is suitable for mobile radio communications is obtained. Moreover, by observing these horizontal-plane radiation pattern, it can be seen that even if an antenna pattern 7*a* and passive element pattern 7*b* are formed on an antenna circuit board 7 installed inside the antenna case section 2, virtually omnidirectional characteristics can be obtained in the horizontal plane in both the GSM and DCS frequency bands.

In the multi-frequency antenna according to the present invention described above, the passive element pattern 7*b* formed on the antenna circuit board 7 is not limited to the shape illustrated in FIG. 7, but rather, can be changed in accordance with the shape of the antenna circuit board 7 and the frequency bands used. In this case, the shape of the passive element pattern 7*b* is set to a shape wherein the width and length thereof are adjusted in such a manner that good VSWR characteristics are obtained in the frequency bands used.

Moreover, the stated values for the HPF 20 and LPF 21 incorporated into the antenna circuit board 7 are not limited to the values described above, but rather, may be changed in accordance with the frequency bands used, and the impedance, etc. of the antenna connection section in the mobile radio device. In this case, they are set to values whereby a good VSWR value is obtained in the frequency bands used.

INDUSTRIAL APPLICABILITY

As stated above, according to the present invention, antenna means comprising a lower element, and an antenna pattern and passive element pattern formed on an antenna circuit board, is able to operate in a first frequency band and a second frequency band, which is approximately double the frequency of the first frequency band, without using a choke coil, and hence the multi-frequency antenna can be compactified.

Moreover, FM/AM broadcasts can be received by the whole antenna including an upper antenna connected via a choke coil to the lower element. The multi-frequency signal received by the multi-frequency antenna is divided by frequency dividing means into a mobile radio signal and an FM/AM signal. In this case, a matching circuit can also be incorporated into the section for dividing the mobile radio bands, and since the frequency dividing means is accommodated inside the antenna case section, a more compact composition for the multi-frequency antenna can be achieved.

What is claimed is:

1. A multi-frequency antenna comprising:

an antenna circuit board, on which are formed an antenna pattern, and a passive element pattern in the proximity of said antenna pattern;

an antenna case section for accommodating said antenna circuit board; and an antenna element, in which a choke coil is disposed between an upper element and a lower element, the lower end of said lower element being connected to the upper end of said antenna pattern formed on said antenna circuit board when said antenna element is installed on said antenna case section;

wherein antenna means comprising said lower element, said antenna pattern and said passive element pattern is able to operate in a first frequency band, and a second frequency band, which is approximately double the frequency of the first frequency band.

2. The multi-frequency antenna according to claim 1, wherein said first frequency band and said second frequency band are mobile radio bands.

3. The multi-frequency antenna according to claim 1, wherein the whole of said antenna including said upper element and said choke coil is able to operate in a third frequency band, which is lower than said first frequency band.

4. The multi-frequency antenna according to claim 1, wherein frequency dividing means for dividing said first frequency band and said second frequency band from said third frequency band is incorporated into a circuit board accommodated inside said antenna case section.

5. The multi-frequency antenna according to claim 4, wherein said frequency dividing means includes a matching circuit for said first frequency band and said second frequency band.

* * * * *